US009138635B1

(12) United States Patent
Sines

(10) Patent No.: US 9,138,635 B1
(45) Date of Patent: Sep. 22, 2015

(54) MECHANICAL SHUFFLER

(71) Applicant: Stealth CDS, LLC, Seattle, WA (US)

(72) Inventor: Travis L. Sines, Seattle, WA (US)

(73) Assignee: Stealth CDS, LLC, Seattle, WA (US)

( * ) Notice: Subject to any disclaimer, the term of this patent is extended or adjusted under 35 U.S.C. 154(b) by 0 days.

(21) Appl. No.: 14/553,493

(22) Filed: Nov. 25, 2014

(51) Int. Cl.
*A63F 1/12* (2006.01)

(52) U.S. Cl.
CPC ..... *A63F 1/12* (2013.01)

(58) Field of Classification Search
CPC ..... A63F 1/12
USPC ..... 273/149 R, 149 P
See application file for complete search history.

(56) References Cited

U.S. PATENT DOCUMENTS

| | | | | |
|---|---|---|---|---|
| 5,275,411 | A | 1/1994 | Breeding | |
| 5,584,483 | A | 12/1996 | Sines et al. | |
| 5,676,372 | A | 10/1997 | Sines et al. | |
| 5,695,189 | A | 12/1997 | Breeding et al. | |
| 6,019,368 | A | 2/2000 | Sines et al. | |
| 6,068,258 | A | 5/2000 | Breeding et al. | |
| 6,149,154 | A | 11/2000 | Grauzer et al. | |
| 6,254,096 | B1 | 7/2001 | Grauzer et al. | |
| 6,267,248 | B1 | 7/2001 | Johnson et al. | |
| 6,299,167 | B1 | 10/2001 | Sines et al. | |
| 6,651,982 | B2 | 11/2003 | Grauzer et al. | |
| 6,676,127 | B2 | 1/2004 | Johnson et al. | |
| 7,523,935 | B2 | 4/2009 | Grauzer et al. | |
| 7,677,565 | B2 * | 3/2010 | Grauzer et al. | 273/149 R |
| 7,988,152 | B2 | 8/2011 | Sines | |
| 8,342,526 | B1 | 1/2013 | Sampson et al. | |
| 8,469,360 | B2 | 6/2013 | Sines | |
| 8,485,527 | B2 | 7/2013 | Sampson et al. | |
| 2004/0036214 | A1 * | 2/2004 | Baker et al. | 273/149 R |
| 2008/0284096 | A1 * | 11/2008 | Toyama et al. | 273/149 R |
| 2009/0314188 | A1 * | 12/2009 | Toyama et al. | 108/50.11 |
| 2011/0175285 | A1 * | 7/2011 | Tzeng | 273/149 R |
| 2011/0272881 | A1 | 11/2011 | Sines | |
| 2013/0020761 | A1 | 1/2013 | Sines et al. | |
| 2013/0285324 | A1 | 10/2013 | Sines | |
| 2013/0300059 | A1 | 11/2013 | Sampson et al. | |

* cited by examiner

*Primary Examiner* — Benjamin Layno
(74) *Attorney, Agent, or Firm* — Lowe Graham Jones PLLC

(57) ABSTRACT

A mechanical shuffling apparatus is disclosed having a mechanism for delivering a single card through a horizontally disposed slot such that mechanical damage to the card is minimized and adequate shuffling of a deck of cards is achieved. The horizontally disposed slot is sized to receive a single card and can be adjusted or calibrated by card manufacturer or type. Additionally, the mechanical shuffler has a weight to flatten cards disposed on a horizontal plane. By keeping cards flat and minimizing mechanical damage to the card the mechanical shuffler disclosed herein also avoids delays and damage caused by jamming.

20 Claims, 21 Drawing Sheets

MECHANICAL SHUFFLER

FIELD OF THE INVENTION

The invention relates to a card shuffler and more particularly to a mechanical card shuffler for randomly shuffling playing cards.

BACKGROUND OF THE INVENTION

Casinos, card rooms, and other gaming establishments employ many dealers. The dealers shuffle cards, deal the cards, take bets, and otherwise play the game. Substantial amounts of the dealers' time is spent shuffling the decks of cards in preparation for the ensuing hands. During the time the dealer is shuffling, the game table is inactive and bets are not being placed. From the standpoint of the casino, it is desirable to minimize the time spent in preparing the decks of cards for additional play.

A number of prior art card deck shuffling machines have been invented. Most of the prior automatic shufflers have suffered from various problems. Many are relatively slow and do not help the basic problem encountered by the gaming establishment. Others are relatively complex and thus expensive to build and maintain.

Another problem area suffered by both manual and automated shuffling techniques is associated with having concentrated groupings of cards. These concentrations or "slugs" can occur with respect to cards having a value of 10 such as in playing blackjack. A skilled card-counting gambler can take advantage of such slugs to turn the odds against the casino and in favor of the card counter. Such slugs can also indicate the failure of prior art shufflers to effectively rearrange the order of cards in a deck or decks being shuffled.

Thus there remains a strong need for improved shuffling machines which can effectively reorder a deck or series of decks. Additionally, there remains a need for an improved automatic shuffler which is relatively easy to build, operate, and maintain.

In one shuffler of the prior art, U.S. Pat. No. 5,584,483, ejectors are mounted adjacent an unshuffled stack holder, which can be stationary or movable. Cards are ejected and discharged from the unshuffled stack at various random positions. The ejectors can be mounted on a movable carriage. Ejectors of this sort can be problematic because they can damage the card edges from impact and generate dust that can foul the internal workings of the apparatus unless it is consistently cleaned and maintained. Furthermore, the ejector apparatus does not fully deliver the card to the shuffled stack, so a variety of problems can happen with the delivery of the card. For example, sometimes the ejector can hit more than one card causing doubles or more to be delivered to the shuffled stack. Moreover, if two cards are stuck together for one reason or another, they often will not become separated upon impact of the ejector, causing doubles to be delivered to the shuffled stack.

In another shuffler of the prior art, U.S. Pat. No. 7,988,152, an unshuffled stack of cards sits on-edge and an exciter is adapted to impart vibrational action to the supported cards in the unshuffled stack. Cards drop in a random fashion by controlling the relative position of the cards over one or more card slots. These arrangements function well enough in terms of shuffling the cards, however, the system only allows for entering cards "on edge," not easily permitting the continuous addition of spent cards that have been played to the unshuffled deck for reshuffling and therefore continuous dispensing of cards. For certain games, such as, for example, Pai Gow, it is advantageous to provide the ability to place spent cards back in the shuffler for shuffling without having to completely empty the shuffler of unshuffled cards.

Another problem with prior art shufflers of the type described above in U.S. Pat. No. 7,988,152 is that the cards drop by the force of gravity and can become snagged or stuck and not fall into place if the cards are damaged or warped. Furthermore, the slot through which unshuffled cards pass is located underneath the unshuffled cards and the unshuffled card sits on an edge and must rotate into a horizontal plane to be delivered to the dealer. This rotation adds extra time before the dealer may deal cards. In a casino environment, time efficiencies are extremely important to keep games moving and increase the number and amounts of bets placed, so the additional time to rotate the cards into a horizontal plane prior to dealing can add up.

An additional problem presented by shufflers of the prior art such as those disclosed in U.S. Pat. No. 7,988,152 is that the slot through which cards pass from the unshuffled stack into the shuffled stack can become jammed with one or more cards. This is because there is no mechanism by which the cards are completely delivered through the slot from the unshuffled deck to the shuffled deck. Absent such a complete delivery mechanism, there exists substantial risk of doubles making it through the slot or of the slot becoming jammed with one or more cards. Furthermore, the leading edge of the card may not always hit the center of the slot, causing impact and damage to the leading edge of the card, which also generates dust and can foul the internal mechanisms of the shuffler.

In the prior art shuffler of the kind described in U.S. Pat. No. 8,342,526 a shuffler is provided that uses one or more rollers and a pushing member which is used to "seat" unshuffled cards into a dealing rack (shuffled card rack). Each card is rolled off the bottom of the stack in a sequential order and is placed in a position in a rack which is randomly positioned to accept such card. These various types of shufflers suffer from a variety of problems related to the use of rollers and multiple moving parts and mechanisms. The rollers in general move the cards through a variety of twists and turns and, in so doing, the cards can become warped and damaged. The shufflers of these various types also involve several different sets of moving parts and mechanisms. The use of multiple moving parts and mechanisms can provide areas for breakdown in the shuffling apparatus and require repeated and constant maintenance or frequent repair. Furthermore, shufflers involving multiple moving mechanisms of this type can take up a lot of space.

Therefore, there exists a need for a mechanical shuffler that is compact and can shuffle cards on the fly in a continuous fashion so as to not substantially interrupt play. There also exists a need for a mechanical shuffler that avoids the use of ejectors, rollers, or like mechanisms which can damage the cards and generate excessive amounts of card dust that might foul the internal mechanisms of the shuffler. There also exists a need for a shuffler that completely and randomly delivers a single card at a time from an unshuffled stack to a shuffled stack and thereby avoids the problem of cards snagging to jamming in the shuffling mechanism. Finally there exists a need for a mechanical shuffler that is programmable for dealing hands specific to certain types of games wherein spent cards may be placed directly back into the machine at any time during the play to be further dealt so as to avoid delays in play.

SUMMARY OF THE INVENTION

The invention is a mechanical shuffler comprising the following, a generally planar base, a platform sized to receive at least one deck of unshuffled cards, the platform movable in a direction of travel normal to the generally planar base, a first electrically powered motor mechanically coupled to the platform and configured to raise or lower the platform in response to a first signal, a slot positioned adjacent to the platform and sized to receive a single card from a deck of unshuffled cards wherein the deck of unshuffled cards rests atop the platform and wherein the slot is in communication with an area for the delivery of shuffled cards, a generally planar shim having a thickness approximately equal to the thickness of a single playing card and having a generally rectangular void, wherein the generally rectangular void is sized to allow the deck of unshuffled cards to pass through it, and wherein the generally planar shim is horizontally movable in a direction normal to the direction of travel of the platform and the unshuffled deck of cards, and a second electrically powered motor mechanically coupled to the generally planar shim wherein said second electrically powered motor is configured to move the generally planar shim in response to a second signal.

The invention also encompasses a mechanical shuffler comprising the following: an elevator for vertically moving a stack of unshuffled cards, a slot positioned adjacent to the elevator and sized to receive a single card from a deck of unshuffled cards, and a shim having a generally rectangular void, wherein the generally rectangular void is sized to allow the deck of unshuffled cards to pass through it, and wherein the shim is horizontally movable in a direction normal to the direction of travel of the elevator and the unshuffled deck of cards.

The invention also encompasses a method wherein the method includes one or more of the following steps: vertically moving a stack of unshuffled cards to a random position relative to a slot positioned adjacent to the stack of unshuffled cards, providing a shim having a generally rectangular void, wherein the generally rectangular void is sized to allow the deck of unshuffled cards to pass through it after the stack of unshuffled cards has been moved to a random position relative to the slot, moving the shim horizontally in a direction normal to the direction of travel of the unshuffled deck of cards such that a single card is selected at random from the stack of unshuffled cards and moved through the slot and into an area for the delivery of shuffled cards.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
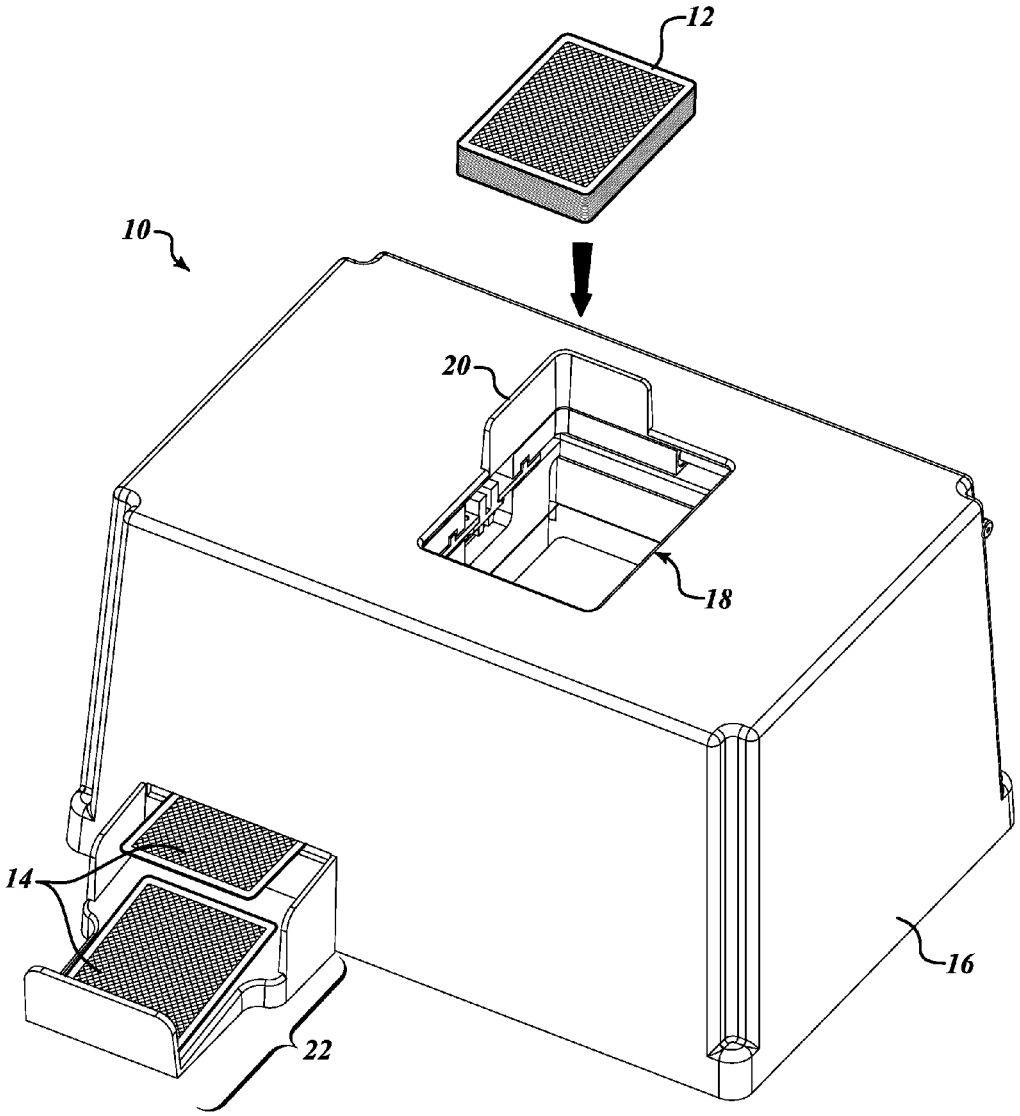
FIG. 1 is a perspective view of a mechanical shuffler made in accordance with principles of the present invention.

Mechanical shuffler 10 is shown in FIG. 1 with the cover 16. Preferably, the cover is made from an opaque or semi-opaque plastic, but the invention also contemplates use of a translucent plastic material. The shuffler 10 includes a receiving space 18 that is cut into the top of cover 16. The receiving space 18 is sized to receive cards to be shuffled 12. These cards to be shuffled 12 can be cards from a newly opened deck of cards or they can be cards from spent (i.e., played) cards dealt.

Receiving space 18 is also formed at one corner with an integral piece of plastic forming a guiding member 20. Guiding member 20 can be used to straighten the stack of unshuffled cards 12 such that any misaligned cards are put into proper alignment so that the entire stack of unshuffled cards 12 can be placed inside of receiving space 18. As depicted in the illustrated embodiment, guiding member 20 has rounded corners and is formed generally to occupy the top left-hand corner of receiving space 18. Alternative shapes and configurations are contemplated.

Shuffled cards 14 are dispensed as shown in FIG. 1 through a card catch assembly 22. The card catch assembly 22 is integrally formed into the cover 16 but can alternatively be a separate piece and in any configuration suitable for dispensing cards or hands to be dealt.

Figure 2:
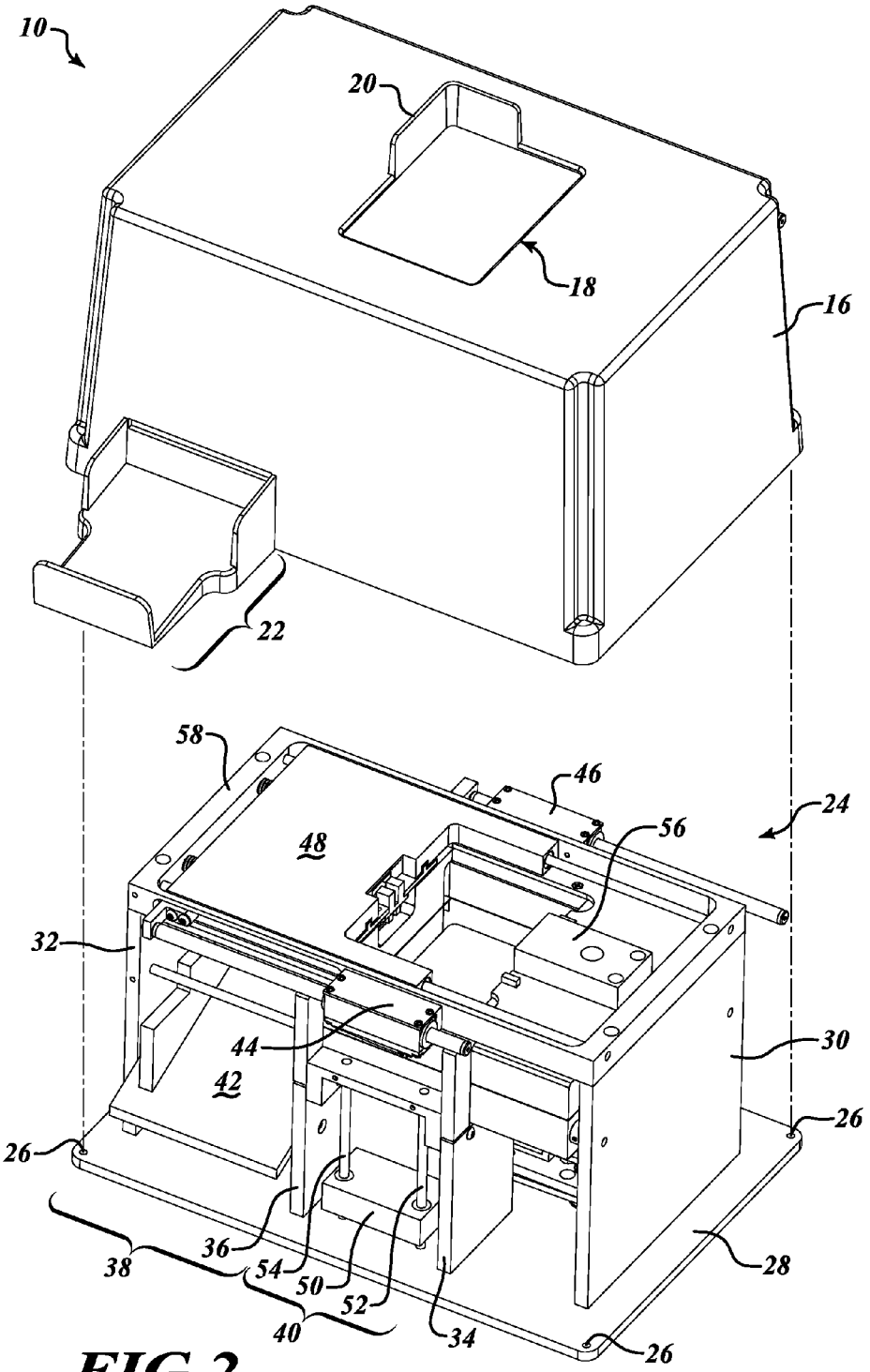
FIG. 2 is a perspective view of a mechanical shuffler made in accordance with principles of the present invention with the cover removed.

With reference now to FIG. 2 cover 16 is removable and when so removed exposes the internal shuffling mechanism 24 of the illustrated embodiment. One of ordinary skill in the art will appreciate that that particular mechanical arrangements for shuffler 10 and in particular, the internal shuffling mechanism 24, can vary widely and that specific embodiment illustrated is not intended to limit the invention claimed to the particular mechanics employed or illustrated. With that said, FIG. 2 shows that shuffler 10 and an internal shuffling mechanism 24 that is generally comprised of a generally planar base 28 which includes a plurality of fastener holes 26 for securing the cover 16. Generally, the shuffler 24 also includes a first side wall 30, second side wall 32, and first front support 34, a second front support 36, and a top framing member 58. Shuffler 10 seen in FIG. 2 is of the front side of the mechanical arrangement and this shows an area for vertical articulation and a vertical articulating mechanism 40 as well as an area for the delivery of shuffled cards with a card delivery mechanism 38.

The card delivery mechanism employed in the illustrated embodiment is through the use of a slide 42. In the illustrated embodiment, slide 42 is of a sufficient slope to permit the shuffled cards to slide by the force of gravity to the card catch assembly 22. The vertical articulating mechanism 40 and card delivery mechanism 38 are separated by a support 36.

Figure 3:
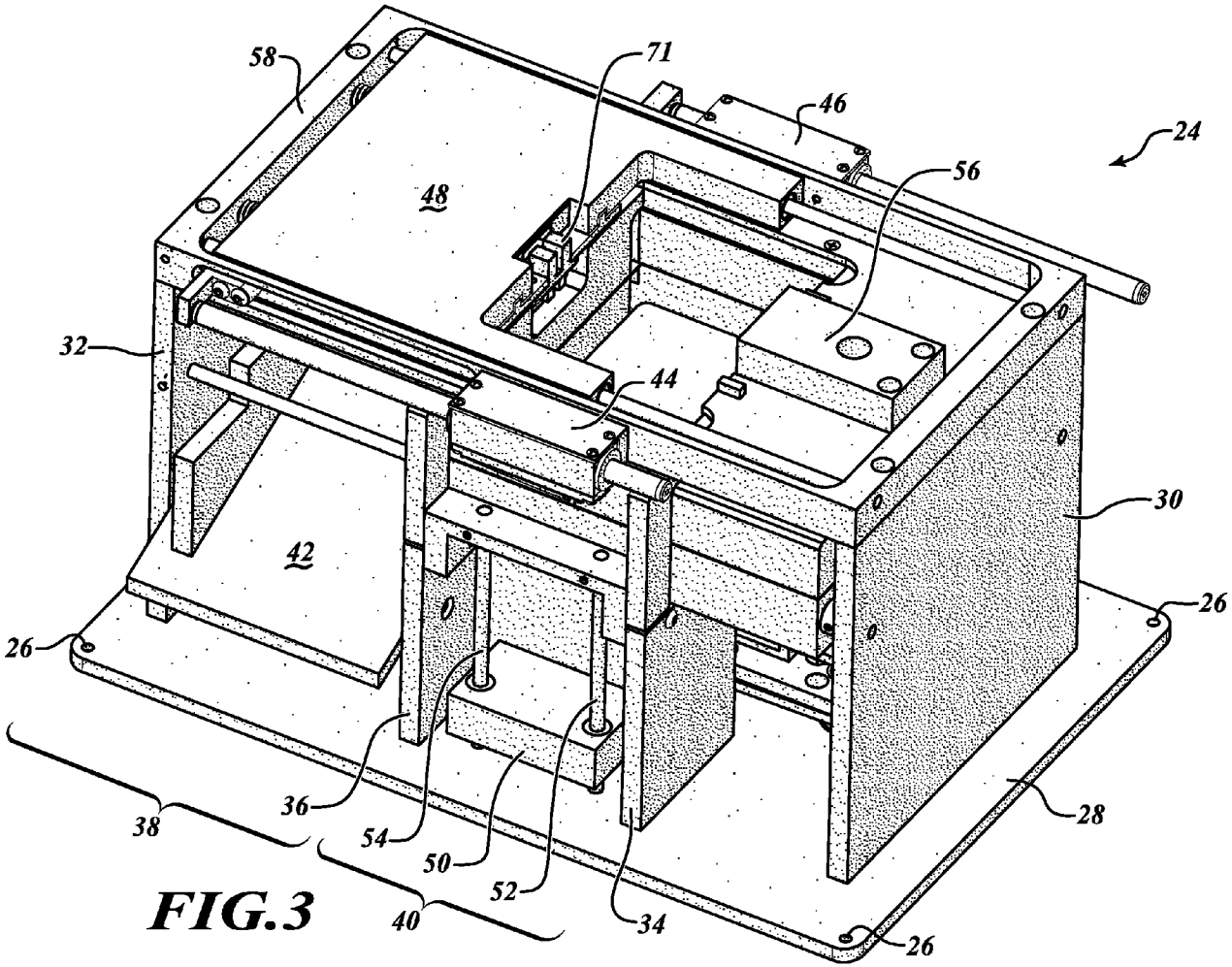
FIG. 3 is a close-up, a perspective, front view of a mechanical shuffler made in accordance with principles of the present invention without the cover.
Figure 4:
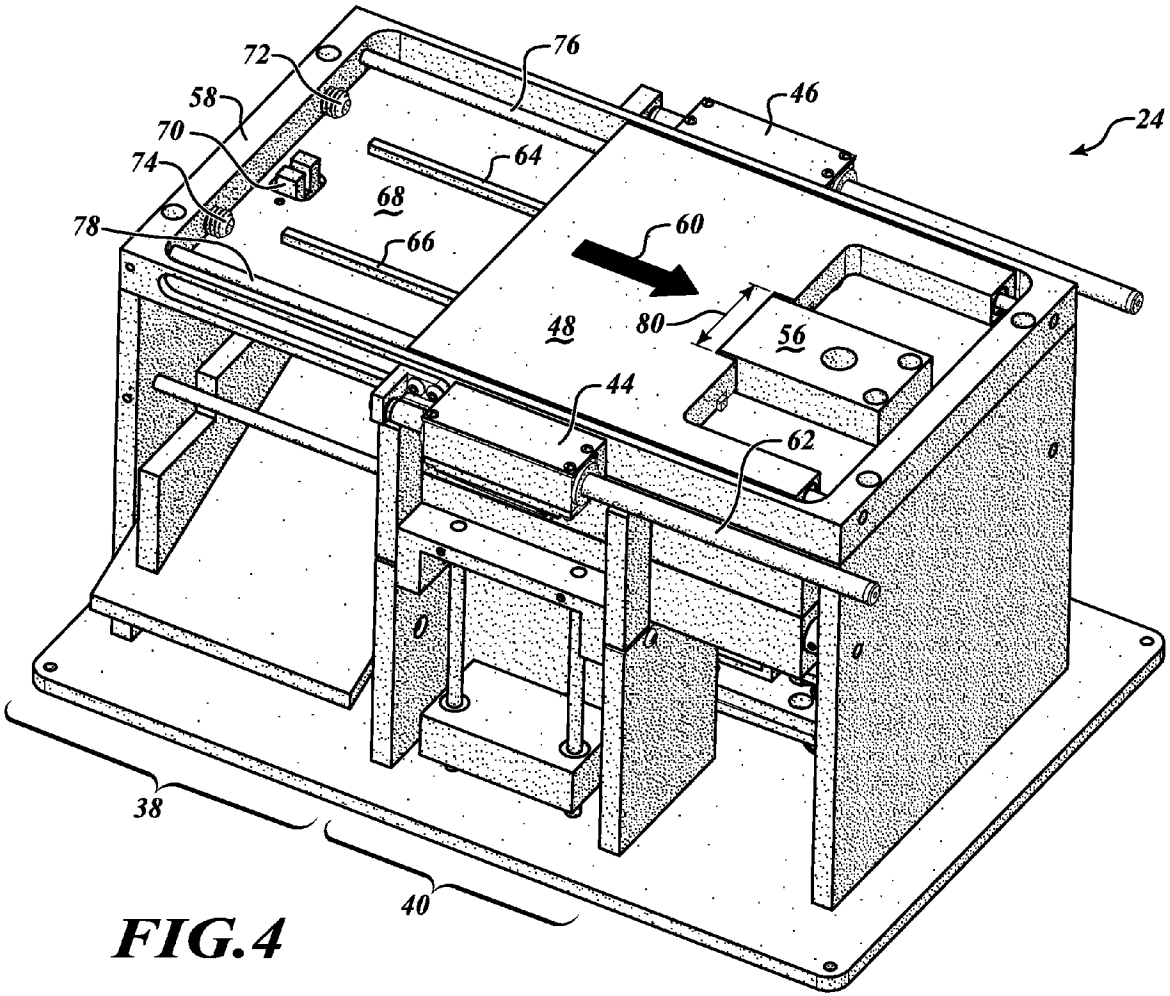
FIG. 4 is a close-up, a perspective, front view of a mechanical shuffler made in accordance with principles of the present invention.

As shown in FIGS. 2-4, shuffler 10 as illustrated, preferably includes at least two linear servo motors. The first linear servo motor 44 drives the horizontally articulating cover 48, which optionally can include a weight (not shown) that can freely sit atop the cards to be shuffled 12. The use of a free weight atop cards to be shuffled is advantageous to provide a means by which the cards to be shuffled 12 are flattened. Throughout the course of play, it is not unusual for card players to hold cards in their hand and to warp or bend cards. Cards can also become warped or bent from the method by which a player or the dealer places them on the table or picks them up from the table. By affixing a weight that sits atop the cards to be shuffled, any warped cards are held in a substantially flat orientation notwithstanding being warped or bent.

First linear servo motor 44 and second linear servo motor 46 are preferably linear DC-servomotors consisting of a non-magnetic metal alloy casing (stator) with a built-in coil and analogue Hall sensors for rapid and precise movement and articulation. The servo motors 44 and 46 have a high precision metal cylinder filled with permanent magnets, the cylinder capable of moving concentrically inside the stator resulting in a miniature linear motor drive mechanism. Preferably the linear servo motors are of the Quicksaft® brand, model LM1247, available from Faulhaber Minimotor SA.

As shown in FIGS. 2-4, shuffler 10 includes a vertical articulating mechanism 40 that is further comprised of vertically moving member 50 a first rod for vertical articulation 52 and a second rod for vertical articulation 54. Additionally, the top assembly for vertical articulation 56 can also be seen in FIGS. 2-4. Furthermore, shuffler 10 as illustrated includes an optical switch 71. Optical switch 71 is preferably a slotted optical switch such as those available from TT Elecronics, Optek Technology sold under the name Photologic®. Optical switch 71 senses when horizontally articulating cover 48 is in the "closed" position, and thus when the shuffler 10 is unable to receive a vertically articulating stack of unshuffled cards 12. One of ordinary skill in the art will appreciate that any switching mechanism is contemplated by the invention and the invention is not necessarily limited to the use of an optical switch as shown.

With particular reference now to FIG. 4, horizontally articulating cover 48 is shown in the "closed" position. Arrow 60 indicates the direction of movement for the horizontally articulating cover 48. When closed, horizontally articulating cover is seated around the top assembly for vertical articulation 56 at an area defined by a notch 80 in the cover 48. When in the "closed" position, the servo arm 62 of the first linear servo motor 44 extends through to the front right of the shuffler 10. Likewise, in this position, first horizontal cover guide 64 and second horizontal cover guide 66 can be seen on the cover mating surface 68. Guides 64 and 66 are meant to keep horizontally articulating cover 48 on a relatively straight track as it moves in a horizontal direction 60. FIG. 4 also shows optical switch 70 as well as a first threaded screw 72 and a second threaded screw 74. In addition, the optical switch 70 is shown. In general, guides 64 and 66, along with optical switch 70, keep horizontally articulating cover 48 from sliding at unwanted times or in response to being tipped to one side or the other. Optical switch 70 senses when horizontally articulating cover 48 is in the "open" position, and thus when the shuffler 10 is able to receive a vertically articulating stack of unshuffled cards 12. Horizontally articulating cover slides generally along a first rod for horizontal articulation 76 and a second rod for horizontal articulation 78, along direction 60 as guided by guides 64 and 66.

Figure 5:
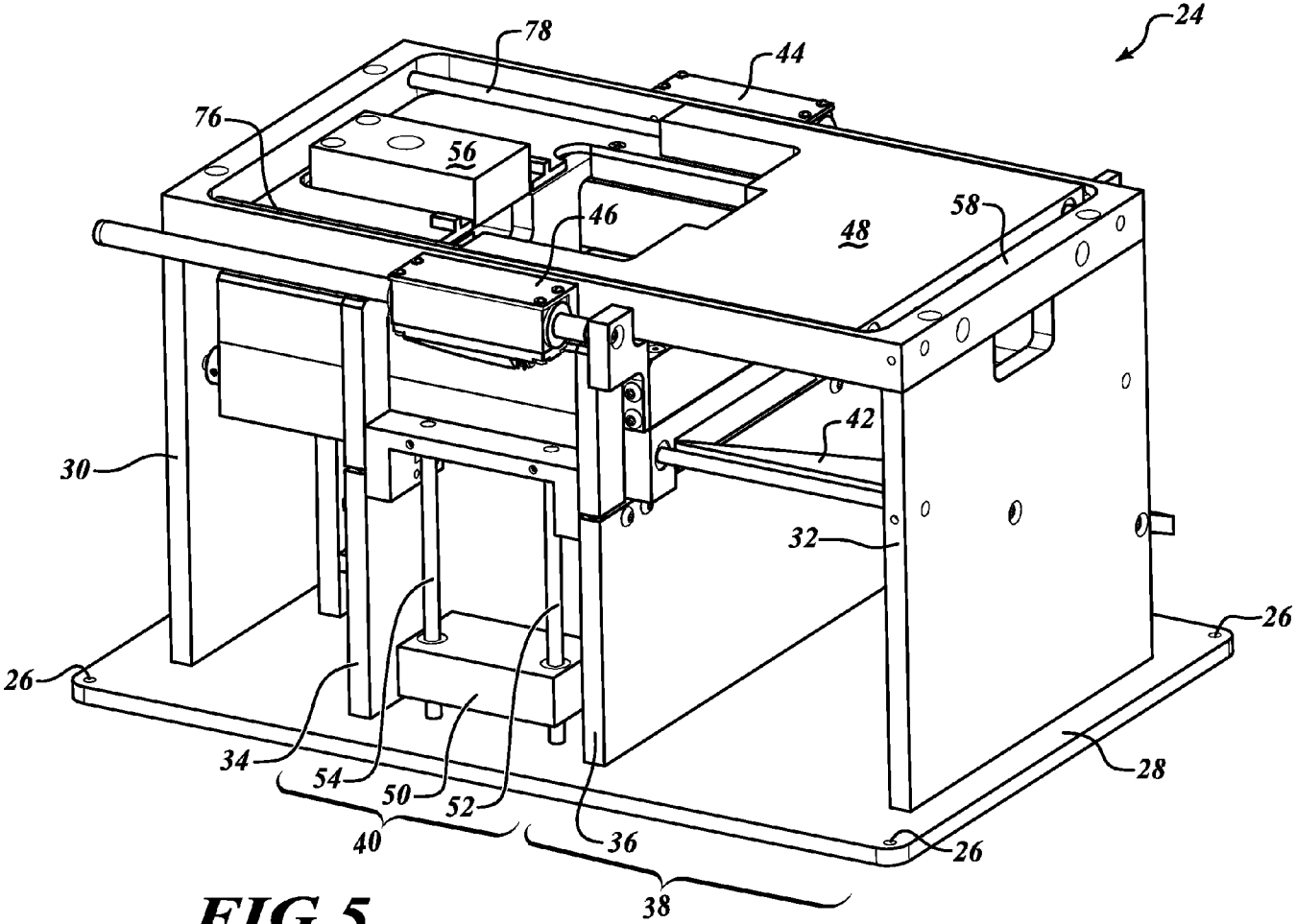
FIG. 5 is a close-up, a perspective, rear view of a mechanical shuffler made in accordance with principles of the present invention.

FIG. 5 shows, in general, the rear of the internal shuffling mechanism 24. From the rear as shown in FIG. 5, horizontally articulating cover 48 is shown in the "open" position and the internal shuffling mechanism 24 is therefore in a position to receive cards to be shuffled 12. One can also see in this view the back of the slide 42 and in particular the top of the incline on which shuffled cards will fall and slide.

Figure 6:
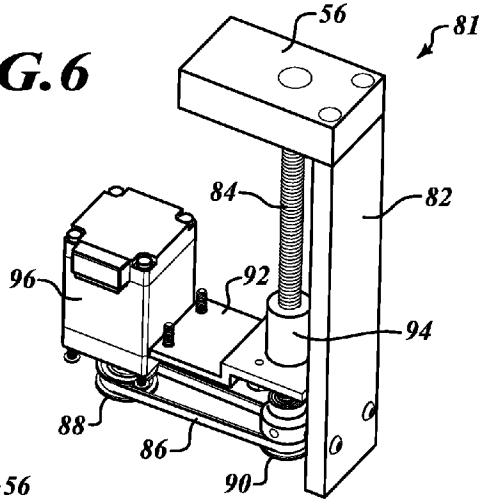
FIG. 6 is a perspective view of a vertical articulation mechanism usable in accordance with principles of the present invention.
Figure 7:
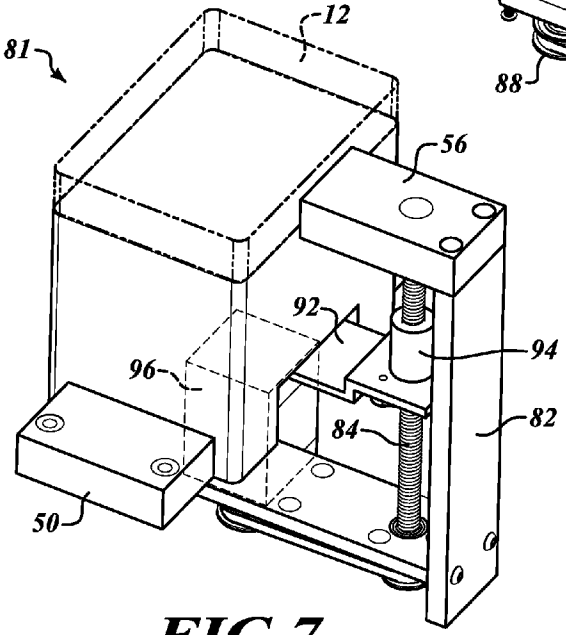
FIG. 7 is a perspective view of a vertical articulation mechanism usable in accordance with principles of the present invention.
Figure 8:
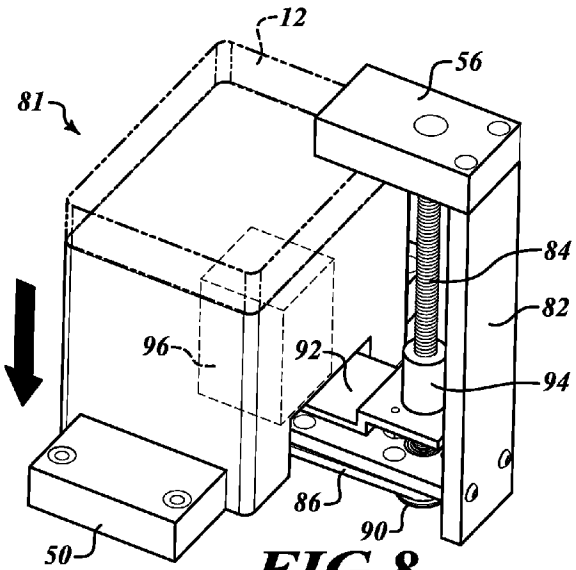
FIG. 8 is a perspective view of a vertical articulation mechanism usable in accordance with principles of the present invention.

With reference now to FIGS. 6-8, the mechanism for vertical articulation 81 is described. The illustrated embodiment includes a mechanism for vertical articulation 81 that is generally comprised of a support 82, a threaded rod 84, a platform support 92, and an internally threaded bore 94. Internally threaded bore 94 is driven up or down depending on the direction of rotation of threaded rod 84. Threaded rod 84 is driven by the action of electric motor 96. Electric motor 96 is mechanically coupled to threaded rod 84 by a belt 86. Belt drive 88 spins by the direct drive provided by electric motor 96. Belt 86 drives threaded rod 84 and the rotation of threaded rod 84 articulates up or down the platform support 92.

As seen in FIGS. 6-8, the mechanism for vertical articulation 81 provides for the vertical movement of a stack of unshuffled cards 12. The stack of unshuffled cards 12 can be one or more full decks. The mechanism for vertical articulation 81 thereby provides an "elevator" type arrangement the raises or lowers a stack of unshuffled cards 12 in a random manner so as to provide a randomized selection of a single card from the stack of unshuffled cards 12. The selection of a single card in this manner is done by determining or identifying the card from the unshuffled stack 12 at a particular fixed point of reference. In the illustrated embodiment, the fixed reference point for selecting a card from the unshuffled stack 12 is fixed relative to the random vertical movement of the elevator apparatus or mechanism for vertical articulation 81. At any given moment in the random vertical movement of the mechanism for vertical articulation 81, the fixed point of reference will select a card at random. This random selection of a single card is useful for the preparation and shuffling of cards or the transformation of the unshuffled deck of cards 12 into shuffled cards 14. In general, FIG. 7 shows the mode in which the mechanism for vertical articulation 81 is elevated and FIG. 8 shows the mode in which the mechanism for vertical articulation is lowered. For example, as unshuffled stack 12 is raised or lowered by the alternating and reversible movement of threaded rod 84, driven as depicted by belt 86, belt drive 88, and rod drive 90, a random card may be selected for inclusion in a hand to be dealt or to be formed.

Figure 9:
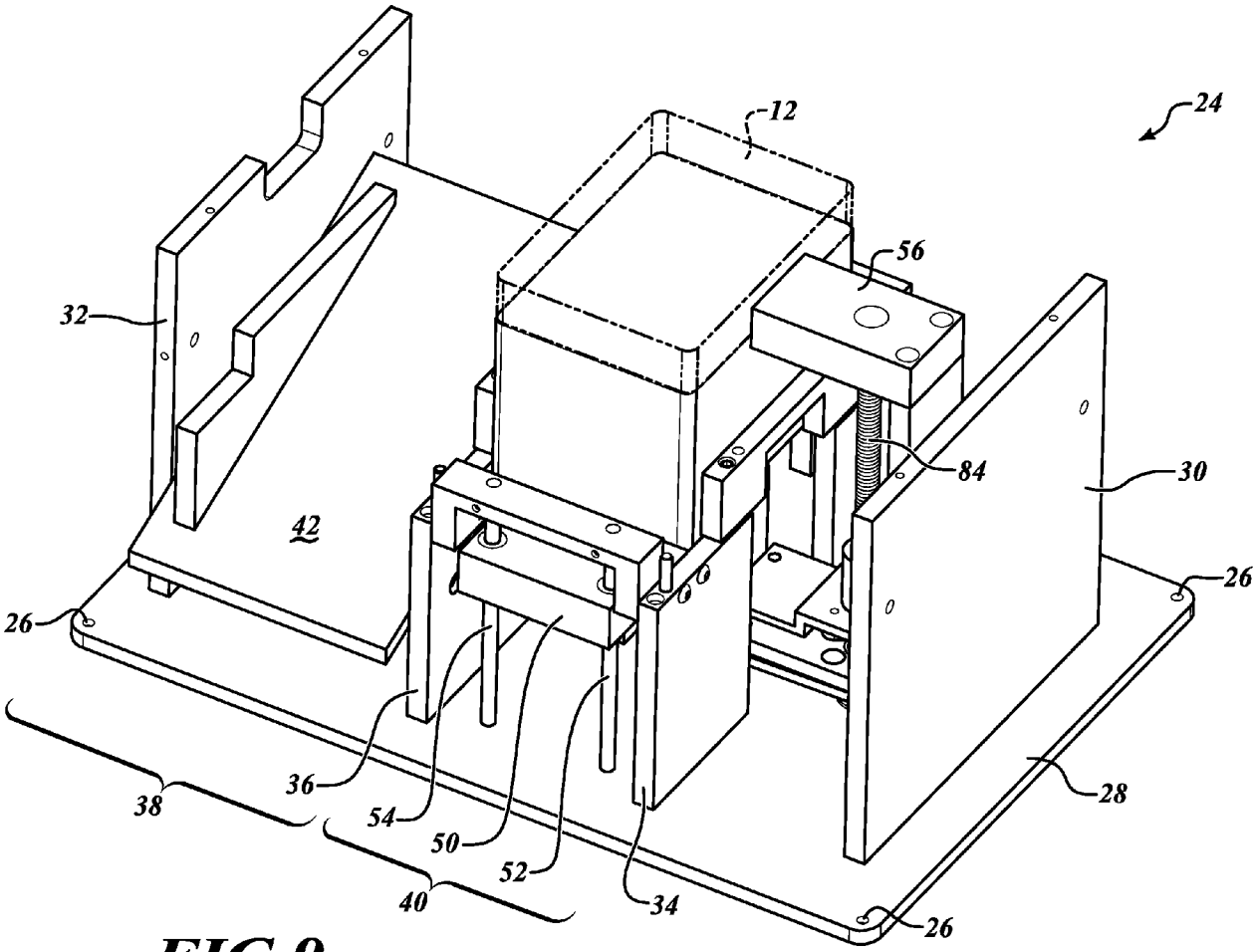
FIG. 9 is a perspective view showing some of the elements of the vertical articulation mechanism usable in accordance with principles of the present invention.
Figure 10:
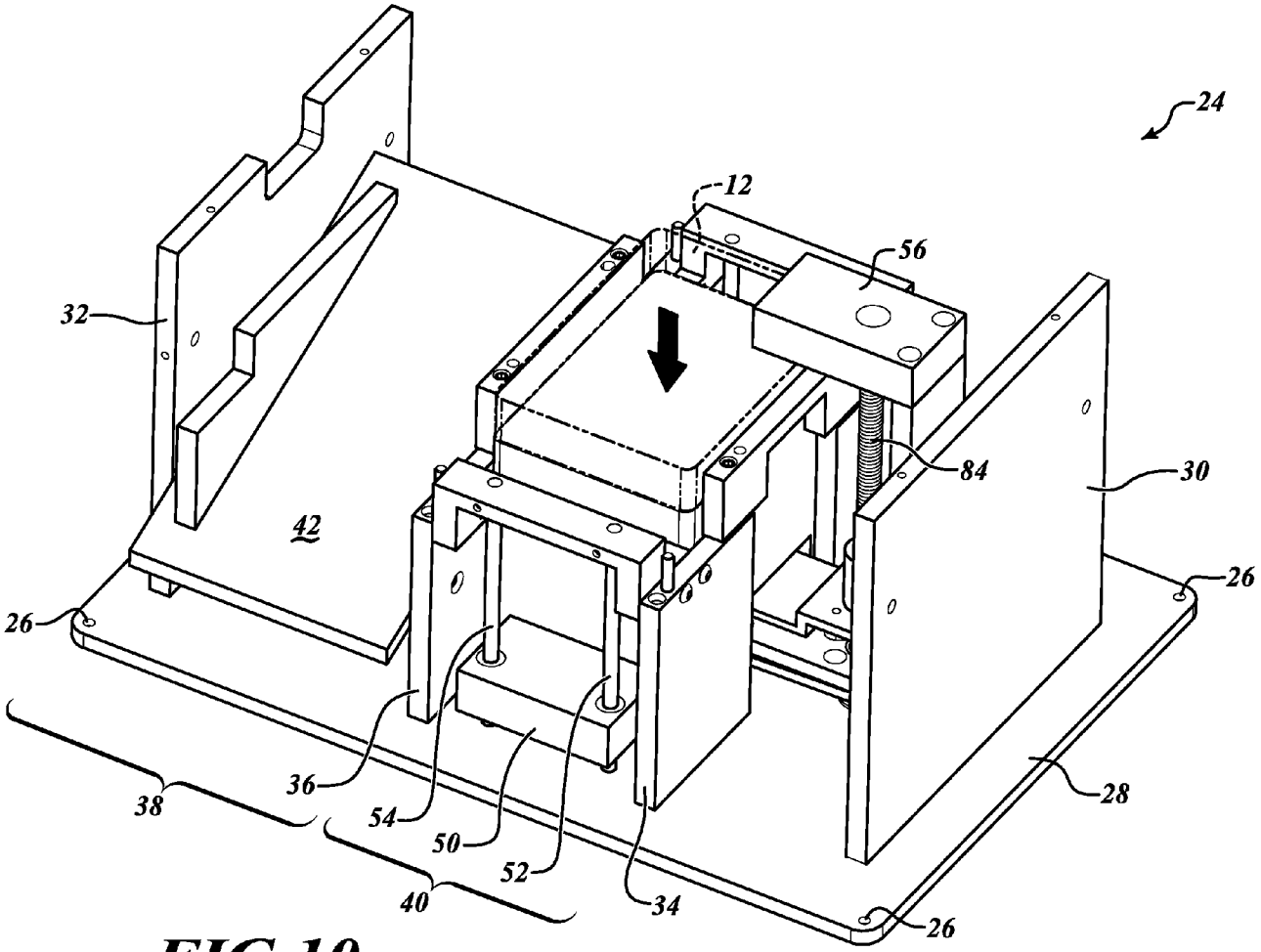
FIG. 10 is a perspective view showing some of the elements of the vertical articulation mechanism usable in accordance with principles of the present invention.

As best seen in FIGS. 9 and 10, the unshuffled stack of cards 12 is raised or lowered in the "elevator" through the mechanism for vertical articulation described above with reference to FIGS. 6-8. One of ordinary skill in the art will appreciate, however, that the particular mechanical arrangements for the vertical articulation of the stack of unshuffled cards 12 is unimportant so long as the stack of unshuffled cards 12 is raised or lowered by any mechanism that provides random selection of a card from the unshuffled cards 12. Any arrangement by which the stack of unshuffled cards are raised or lowered in a random fashion is contemplated by the invention, including but not limited to various belt-drive mechanisms, linear servo motors, or other direct or gear driven arrangements for raising or lowering the stack of unshuffled cards at random.

Figure 12:
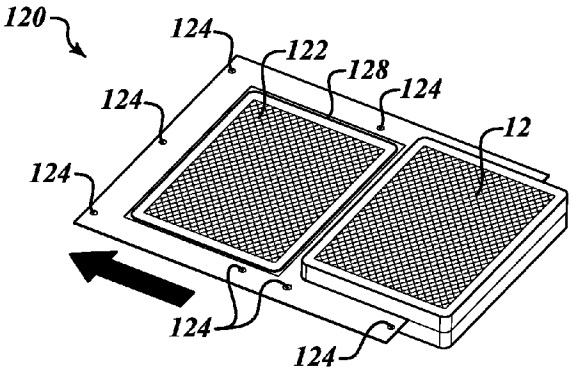
FIG. 12 is a view of a shim usable in accordance with principles of the present invention.
Figure 11:
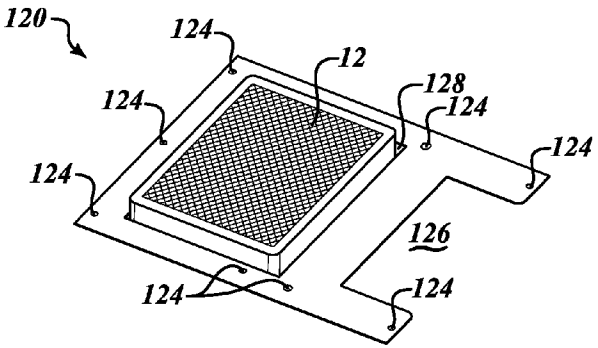
FIG. 11 is a view of a shim usable in accordance with principles of the present invention.
Figure 13:
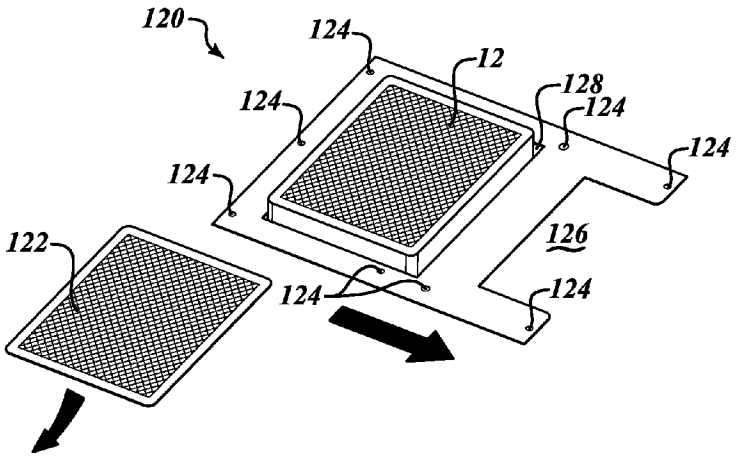
FIG. 13 is a view of a shim usable in accordance with principles of the present invention.

With reference now to FIGS. 11-13, a shim 120 for delivering cards from the unshuffled stack 12 to the shuffled stack 14 is described. As seen in FIG. 11, the shim 120 is comprised of a single sheet of metal formed or fabricated to include a void 128 through which the stack of unshuffled cards 12 can freely pass. Preferably, the void is sized to have dimensions slightly greater than a standard deck of cards, such that the stack of unshuffled cards can only barely pass through the void 128. Shim 120 includes holes 124 for fastening the shim in a structure that can provide for horizontal articulation of the shim 120. As best seen in FIG. 12, the shim 120 fully encases a single card 122 within the void 128. As the arrow in FIG. 12 indicates, the shim 120 preferably moves from left to right, passing through the stack of unshuffled cards 12 at a moment in time where the vertical articulation of the unshuffled stack of cards has ceased, thereby permitting the encasement of a single card 122 within the void 128 of the shim 120. At this point in time, i.e., when the random vertical articulation of the "elevator" has ceased, the shim 120 completely delivers a single card 122 from the stack of unshuffled cards 12 into the stack of shuffled cards 14. Once the single card 122 has been delivered in this manner, the elevator mechanism is thereby able to move again in a random vertical manner, stopping once again for another selection of a card from the stack of unshuffled cards 12 and the delivery of a single card 122 by the encasement of that single card 122 inside of shim 120 within void 128.

Preferably, the void 128 of shim 120 is meant to come into substantially full contact with one or more sides of the single card 122 as it passes or "cuts" through the stack of unshuffled cards 12. In this manner, the single card 122 can be completely delivered by the shim 120 from the stack of unshuffled cards 12 to the stack of shuffled cards 14. Preferably, the complete delivery of a single card 122 from the unshuffled stack 12 to the shuffled stack 14 is done in a manner that does not substantially damage the edge of the single card 122 or otherwise bend or warp the single card 122. Preferably, the shim 120 delivers a substantially flat, non-damaged, non-warped card from the stack of unshuffled cards 12 to the stack of shuffled cards 14.

The shim 120 includes a mounting notch 126 and is preferably of a thickness less than that provided by any single card 122 selected from the stack of unshuffled cards 12. In the embodiment illustrated, the thickness of the shim 120 is 0.010 inches. One of ordinary skill in the art will appreciate that other thicknesses might also be advantageous depending on the thickness of the cards to be shuffled. Typically, the average thickness of a standard playing card is approximately 0.012 inches. Accordingly, the illustrated shim, at a thickness of slightly less than the average thickness of a standard playing card provides a good mechanism by which a single card 122 of average thickness can be pushed by one or more sides of the void 128 in the manner depicted FIGS. 12 and 13.

Other dimensions of the shim 120 are that it is approximately 5.25 inches long and 4.60 inches wide. The dimensions of the void 128 are preferably 2.60 inches by 3.60 inches and the dimensions of the mounting notch 126 are preferably 3.00 inches by 1.25 inches. One of ordinary skill in the art will appreciate that the exact measurements of the illustrated embodiment may be varied and still be within the scope of the invention as claimed. For example, the shim may be configured to be a part of a flexible belt or track that revolves in response to one or more signals. In this alternative embodiment for the shim, the belt or track would have several rectangular voids such as that shown as element 128 in FIGS. 11-13. As a part of a belt or track, the several rectangular voids 128 would rotate such that at least a portion of the track was traveling in a direction normal to the direction of travel of the stack of unshuffled cards 12. The void 128 of the shim in this embodiment is meant to come into substantially full contact with one or more sides of the single card 122 as it passes or "cuts" through the stack of unshuffled cards 12.

Figure 14:
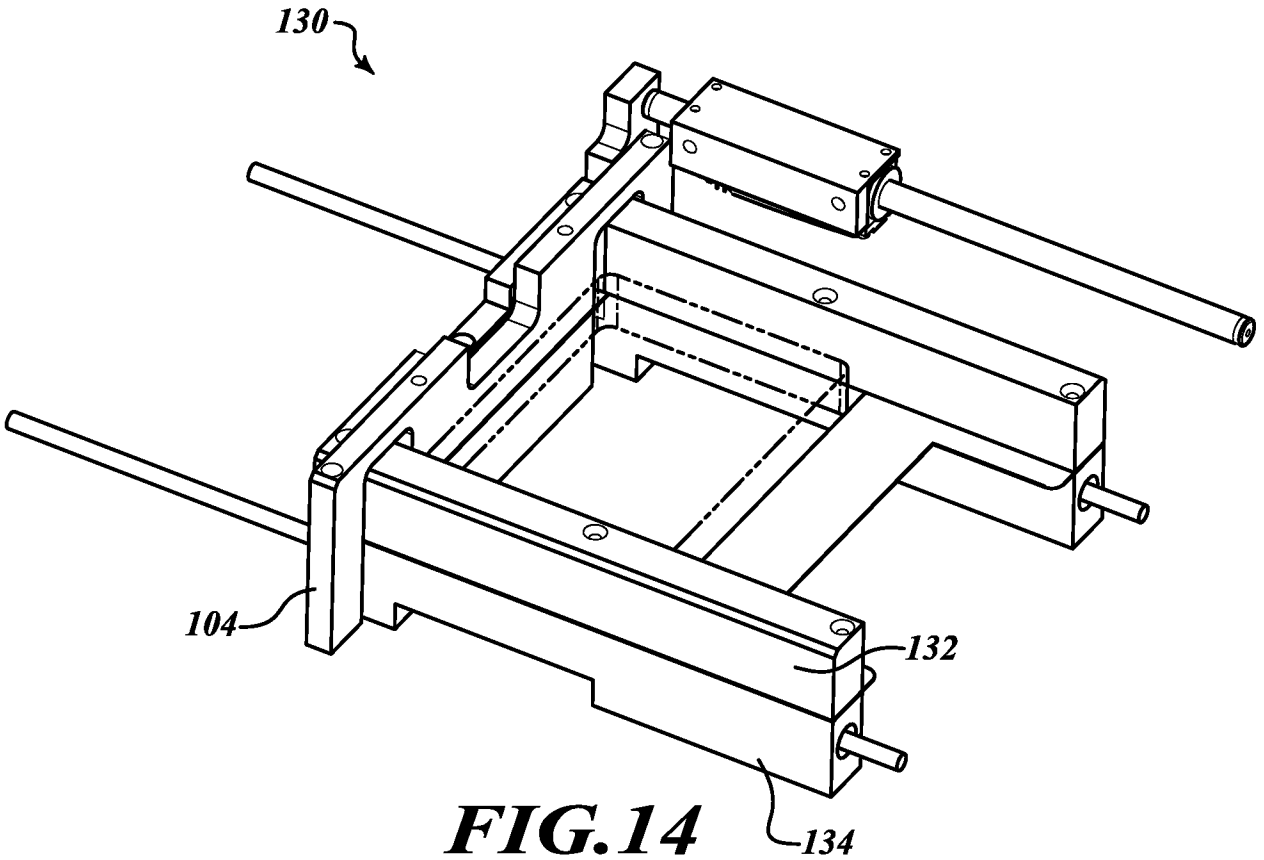
FIG. 14 is a perspective view of a shim assembly and horizontal articulation mechanism usable in accordance with principles of the present invention.
Figure 15:
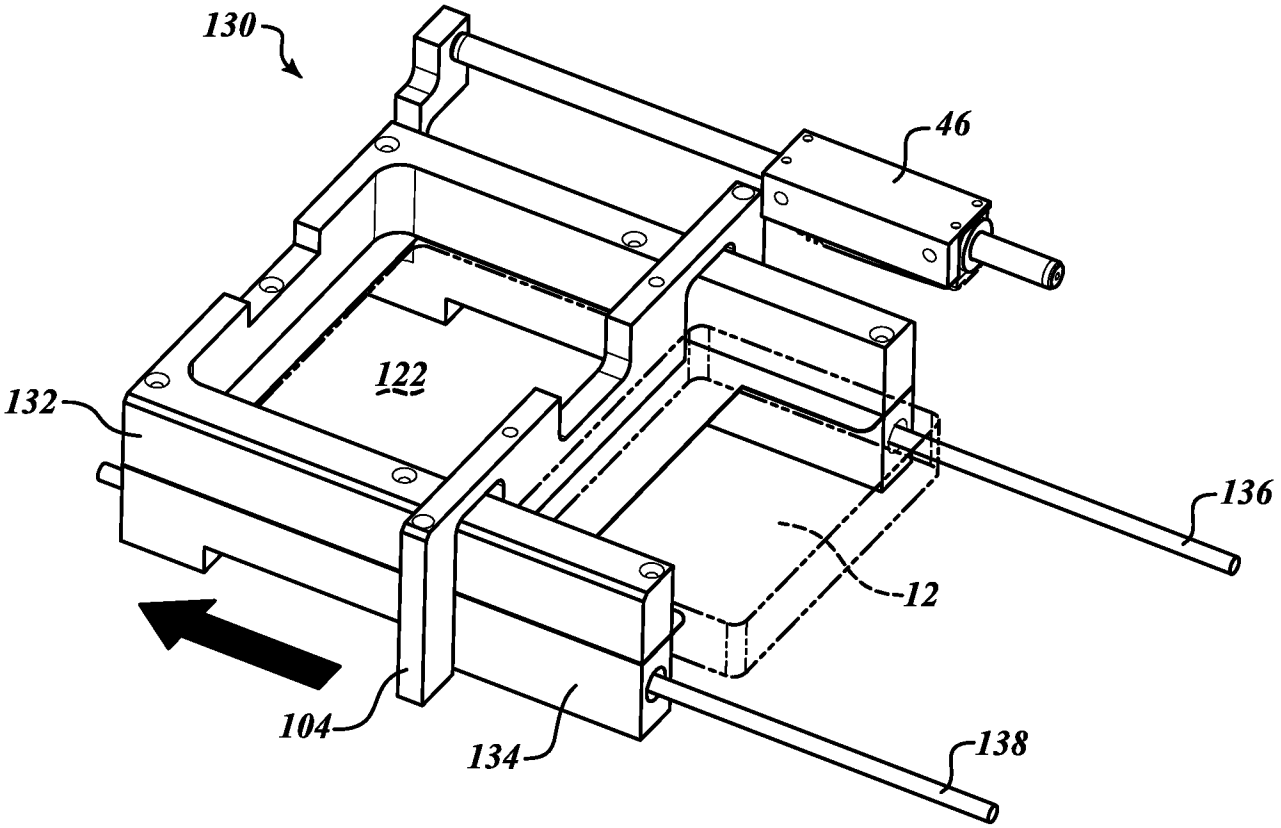
FIG. 15 is a perspective view of a shim assembly and horizontal articulation mechanism usable in accordance with principles of the present invention.
Figure 16:
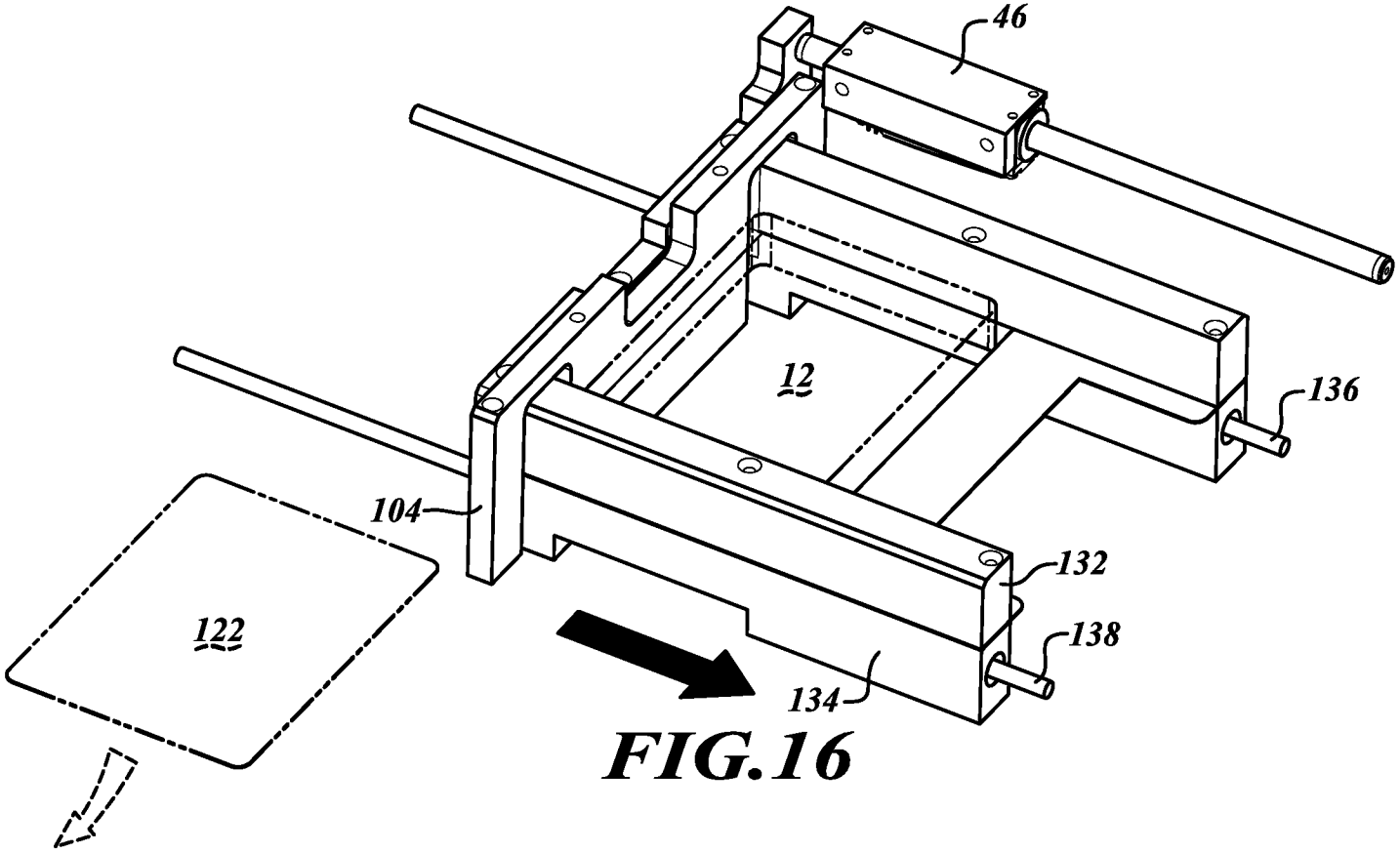
FIG. 16 is a perspective view of a shim assembly and horizontal articulation mechanism usable in accordance with principles of the present invention.

FIGS. 14-16 show the shim assembly 130 as it is articulated in a horizontal direction, thereby cutting through the stack of unshuffled cards 12 and delivering a single card 122 to the stack of shuffled cards 14. Shim assembly 130 is comprised generally of top carriage piece 132 and bottom carriage piece 134. As depicted, the shim assembly 130 slides in a horizontal direction along a first rod for horizontal articulation 136 and a second rod for horizontal articulation 138. The second linear servo motor 46 actuates the shim assembly 130 causing it to slide horizontally in either direction.

Figure 17:
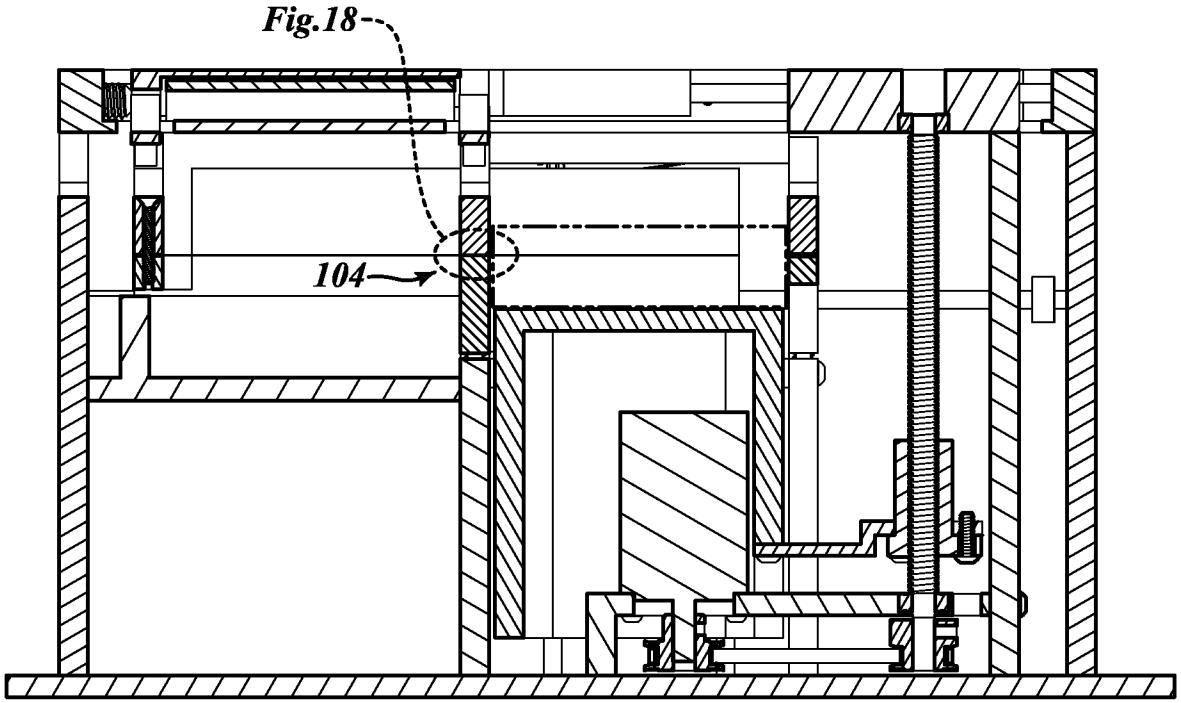
FIG. 17 is a front-side, planar view of a mechanical shuffler usable in accordance with principles of the present invention.

FIG. 17 shows the shuffler 10, and in particular, the internal shuffling mechanism 24 in a planar view from the front. The dashed ellipse identifies a portion of the slot assembly 104. In operation, the shim assembly 130 as depicted in FIGS. 14-16 preferably passes through the slot assembly 104, delivering a card from the unshuffled stack 12 to the shuffled stack 14, whereby the shim 120 completely delivers a single card 122 through the slot assembly 104.

The mechanical shuffler as shown and described may also be equipped with a card alignment camera in communication with vertical motor 242. A card alignment camera may be used to help position the unshuffled stack 12 relative to the slot assembly 104 to ensure optimal position for delivery of a single card through the slot.

Figure 18:
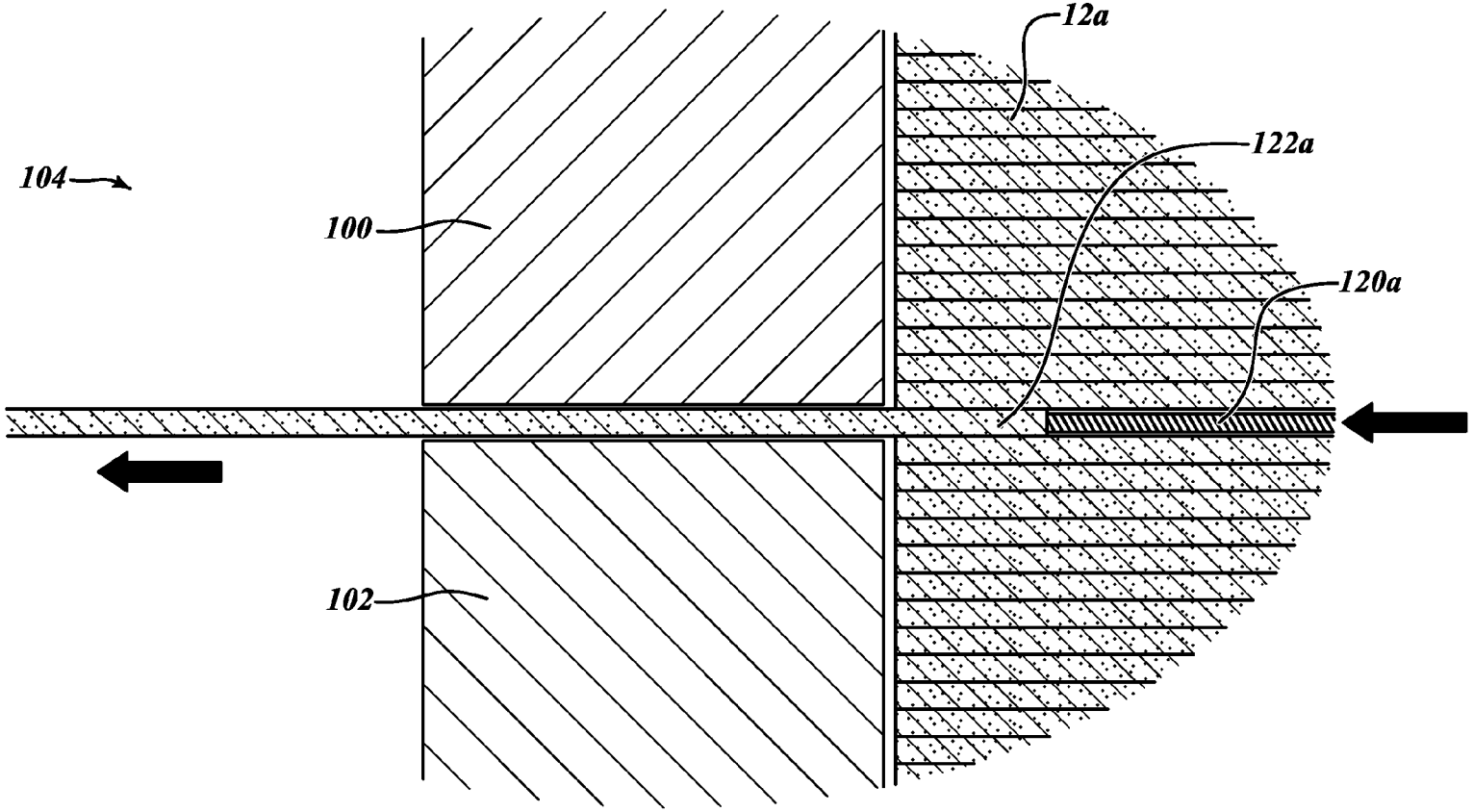
FIG. 18 is a detailed view of the slot, unshuffled cards, and shim usable in accordance with principles of the invention.

FIG. 18 is a magnified, cross sectional view of the slot assembly 104. As shown in magnified view, the slot assembly 104 is comprised of an upper slot structure 100 and a lower slot structure 102. The space between the upper and lower slot structures, 100 and 102, defines the slot 112. The slot is preferably about 0.018 inches wide, thereby permitting a single card of average thickness (0.012 inches) to pass through. As depicted in FIG. 18, the edge of the shim 120 can be seen as element 120*a*. As further depicted in FIG. 18, the stack of unshuffled cards 12 can be seen magnified as 12*a*, and the trailing edge 122*a* of single card 122 can be seen just before it passes through the slot assembly 104 from right to left. As seen in in this FIG. 18, the edge of the shim 120*a* is slightly thinner than the thickness of single card 122*a*, such that it substantially evenly strikes the trailing edge of the card 122, and delivers it completely through the slot assembly 104.

Figure 19:
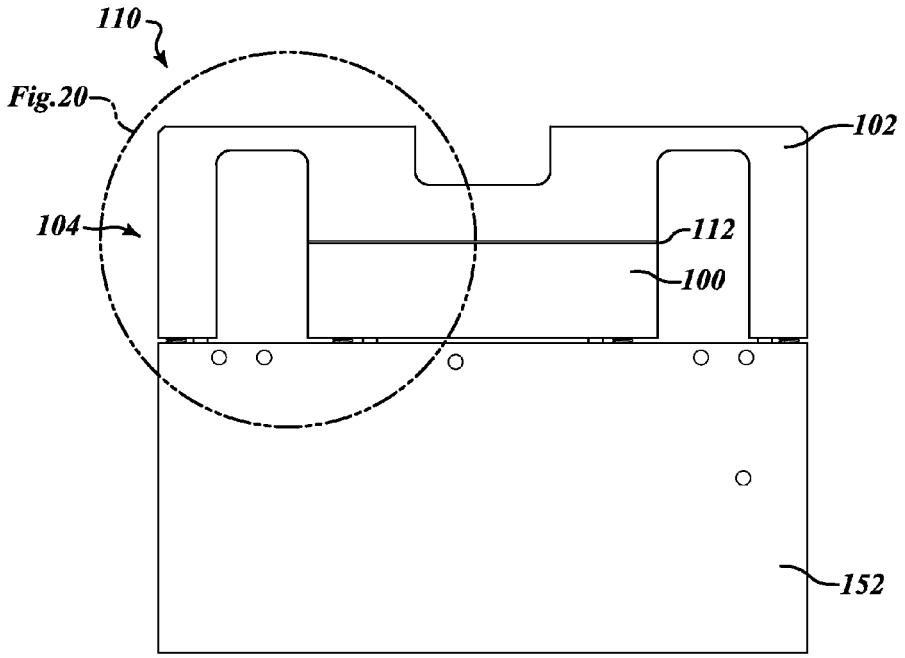
FIG. 19 is a front, planar view of a slot assembly usable in accordance with principles of the present invention.
Figure 20:
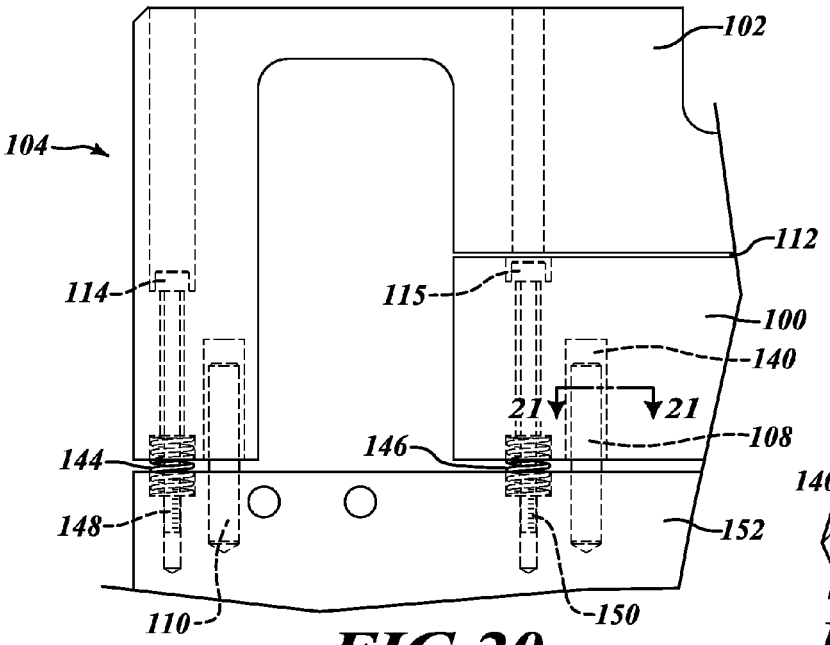
FIG. 20 is a front, partial, planar view of a slot assembly usable in accordance with principles of the present invention.

As depicted in FIGS. 19-20, the slot assembly 104 preferably includes a mechanism for adjusting the width of the slot 112. As shown in FIG. 19, the slot assembly 104 includes spaces on both sides, 116 and 118. Spaces 116 and 118 are the spaces through which the shim assembly 120 passes as it moves horizontally. As seen in FIGS. 19 and 20 the slot assembly 104 is affixed atop a base 152. The base 152 is the same structure marked as element number 36 in FIG. 2, except in FIGS. 19 and 20 the structure is seen in a different orientation.

The width of slot 112 is preferably adjustable by rotation of 4 screws, two of which are depicted in FIG. 20. As seen in FIG. 20, screws 114 and 115 can be turned to adjust the width of the slot 112 by adjusting the relative height of the upper structure of the slot 100 or the lower structure of the slot 102, or both. Screws 114 or 115 are turned into or out of the threads located at 148 and 150 on base 152. Springs 144 and 146 are preferably used to bias the upper slot structure 102 and lower slot structure 100 in a direction away from the base 152. An identical adjustment mechanism as depicted in FIG. 20 exists around the other space, i.e., space 118, of the slot structure 104.

Figure 21:
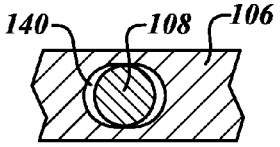
FIG. 21 is a cross-sectional view of the pin assembly usable in accordance with principles of the present invention.

As depicted in FIG. 21, both the upper slot structure 100 and the lower slot structure 102 slide along press fit pins 108 and 110 (two more are located on the other side of the slot assembly 104). Press fit pins 108 and 110 are surrounded by an oblong shaped receiving guide 140. The oblong guide 140 will substantially relieve stresses placed on the pins that might otherwise exist due to adjustments to the width of the slot 112 by turning of screws 114 or 115.

Figure 22:
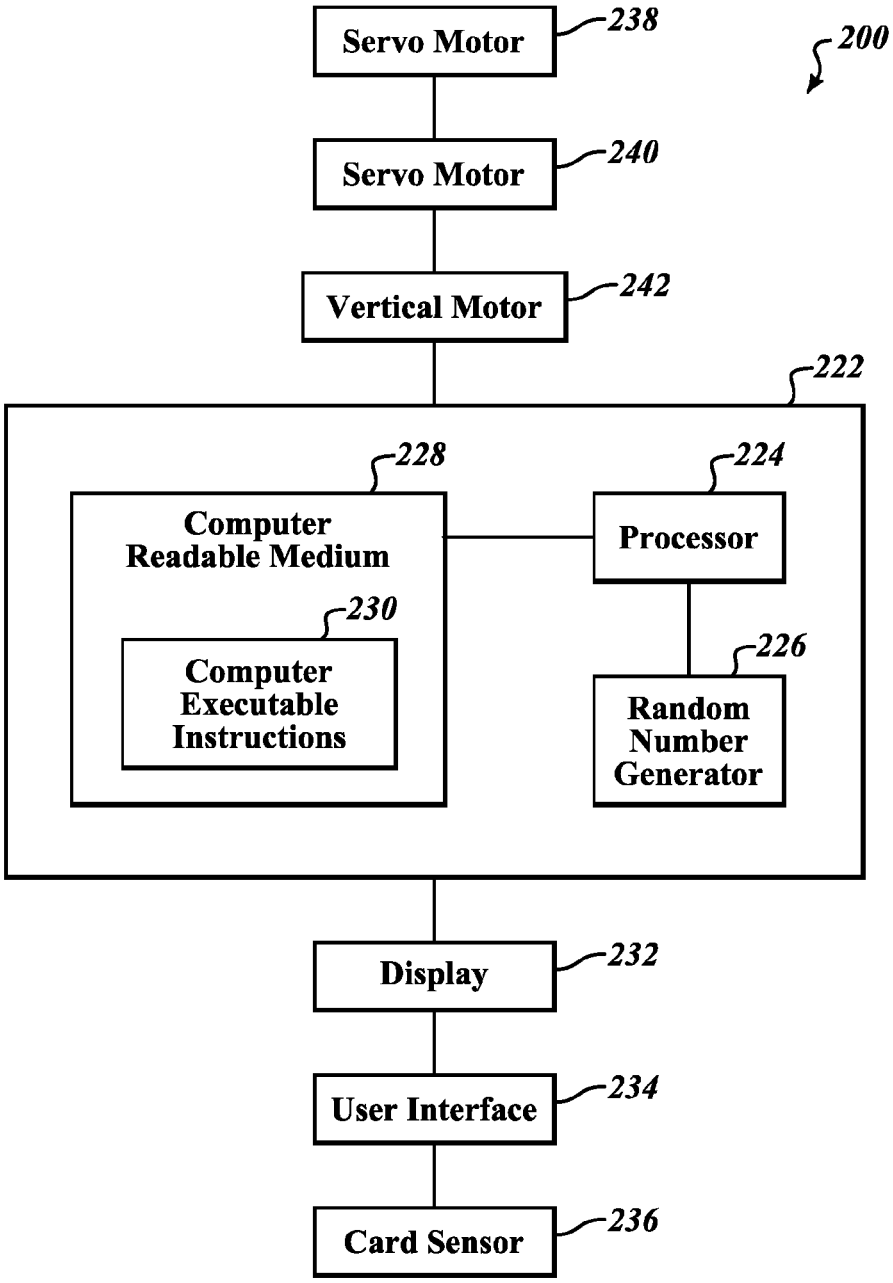
FIG. 22 is a schematic diagram describing an automated shuffling system usable in accordance with principles of the present invention.

Turning now to FIG. 22, a preferable configuration and mode of operation 200 for card shuffler 10 is described and shown. Configuration and mode of operation 200 for card shuffler 10 includes a computer represented by box 222. The computer 222 includes a processor 224 and at least one computer readable medium 230 with computer executable instructions 228. The processor 224 is in communication with a random number generator. Several computational methods are available for generating random numbers. In accordance with principles of the present invention, random numbers can be generated by random number generator 226 any known method and the random number can be sent to processor 224. According to a pivot table, positions of the vertical articulating assembly (shown in FIGS. 6-8) as driven by vertical motor 242 are correlated to random numbers and a signal is sent from computer 222 according to instructions 228 that the vertical articulating assembly should move to a vertical position at random according to the random number generated.

As depicted in FIG. 22, computer 222 is in communication with vertical motor 242, linear servo motor 240 and linear servo motor 238. In the illustrated embodiment, vertical motor 242 is meant to represent the electric motor 96 as depicted in FIG. 6. Furthermore, the linear servo motors 238 and 240 are meant to represent linear servo motors 44 and 46 as depicted in FIG. 2 respectively. According to instructions 228 which are recorded and saved on specially configured computer 222, signals can be send variously to vertical motor 242, linear servo motor 240 and linear servo motor 238 to actuate the various vertical and horizontal assemblies. One of ordinary skill in the art will appreciate that various methods of programming computer 222 with instructions 228 for the movement of motors 238, 240, and 242 exists in the art and are well known. In general, the instructions 228 will ensure that the horizontal movement of the shim assembly 130 (as depicted in FIGS. 14-16) is coordinated with the vertical movement of the vertical articulation mechanism 40 (as depicted in FIGS. 6-8) such that the horizontal movement of shim assembly 130 only occurs when the vertical movement of the vertical articulation mechanism 40 (i.e., the "elevator") has ceased at a random vertical location. At such time, the shim assembly 130 will deliver a single card from the stack of unshuffled cards 12 to the stack of shuffled cards 14.

As further depicted in FIG. 22, computer 222 may be coupled to a display and a user interface. The coupling can be by any means known in the art, including wireless means and the display may be on the shuffler itself or on a remote device such as a mobile phone or tablet. The user interface may be a touch pad located on the shuffler itself, or can be a local or remote keyboard or touch screen.

The configuration 200 as depicted schematically in FIG. 22 may also include an optional card sensor located within shuffler 10 at a location where the identity of cards selected at random from the stack of unshuffled cards can be recorded and stored in memory. The sensing and storing of the identity of specific cards can be useful for a variety of reasons, namely to control or protect against cheating by a player who introduces cards into his or her hand that were not actually dealt, or by providing methods by which a casino can check on the accuracy and efficiency of the dealer. Methods of sensing and recording the identity of cards through the use of a digital camera that senses visually the suit and value of the card and records that suit and value in a log saved to computer memory may be used. Under such a system, keeping photographs is unnecessary, and the log can be kept using very minimal space in memory.

Figure 23:
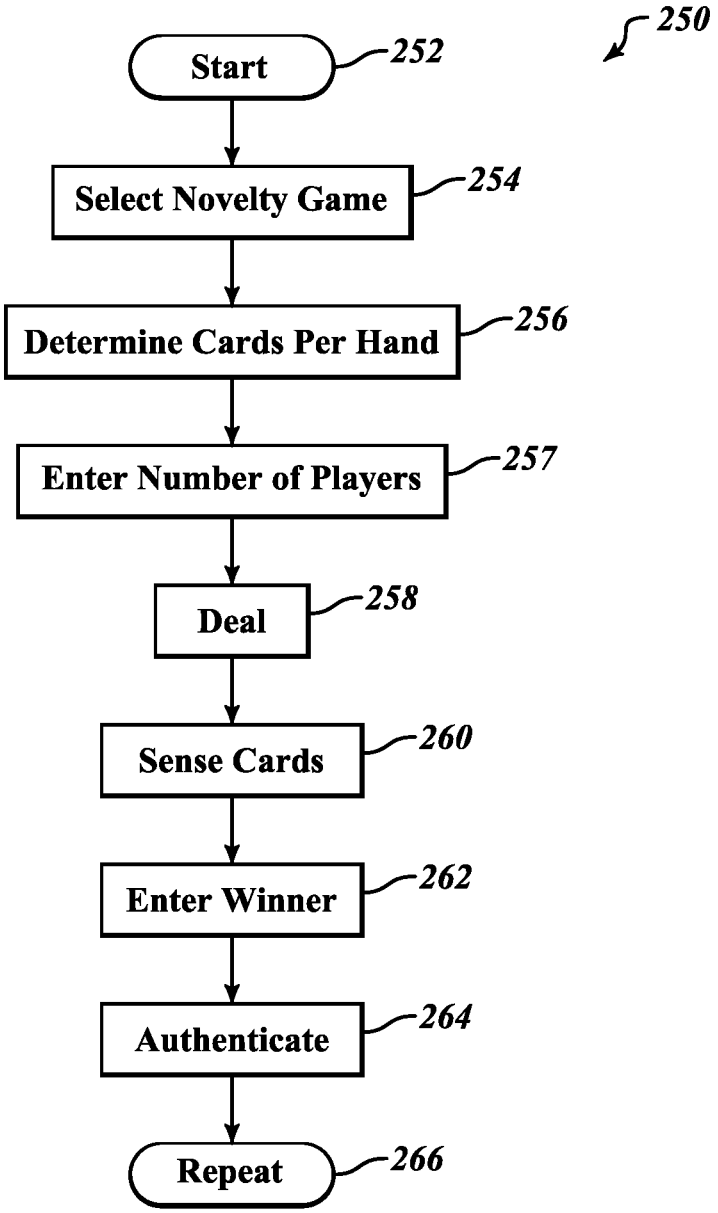
FIG. 23 is schematic diagram describing example steps used in accordance with principles of the present invention.

Turning now to FIG. 23 where a schematic representation is depicted showing a method for use of shuffler 10. According to this method, the shuffler 10 can be programmed to deal hands for any number of games, including casino card games. Casino card games may be dealt by the shuffler 10 in "hand removal mode" wherein the cards may be removed in preset "hands" of one or more cards per player. Casino card games include games such as Pai Gow, Poker, Caribbean Stud, 3-card Poker, Let it Ride, Hi-Card Flush, Casino War, 4-card Poker, and Baccarat, among others.

As depicted in FIG. 23, the method starts with the selection of the casino game to be played. This step is depicted schematically by box 254. Following this step, and depending on the game selected, the computer 222 can be programmed to determine the cards dealt per hand, as represented by box 256. Following the selection of the number of cards to be dealt per hand, the shuffler deals a hand of that number of cards using the mechanical shuffling means described above, whereby a single card is selected a time and moved completely through a slot sized to receive a single card, whereby a shim is used to completely deliver that card to the hand. According to this method, the number of players is also entered into the computer to determine the number of hands needed to be dealt. At this point the hands are dealt 258, and at such time the identity of cards are sensed 260, and the winner of the game is recorded 262. Through this process the purported winner at the table can be authenticated 246 as checked against the winner the computer 222 determines. Once the hand is played, the spent or played cards can be returned directly to the cards to be shuffled 12 without substantial delay in play to shuffle cards.

Figure 24:
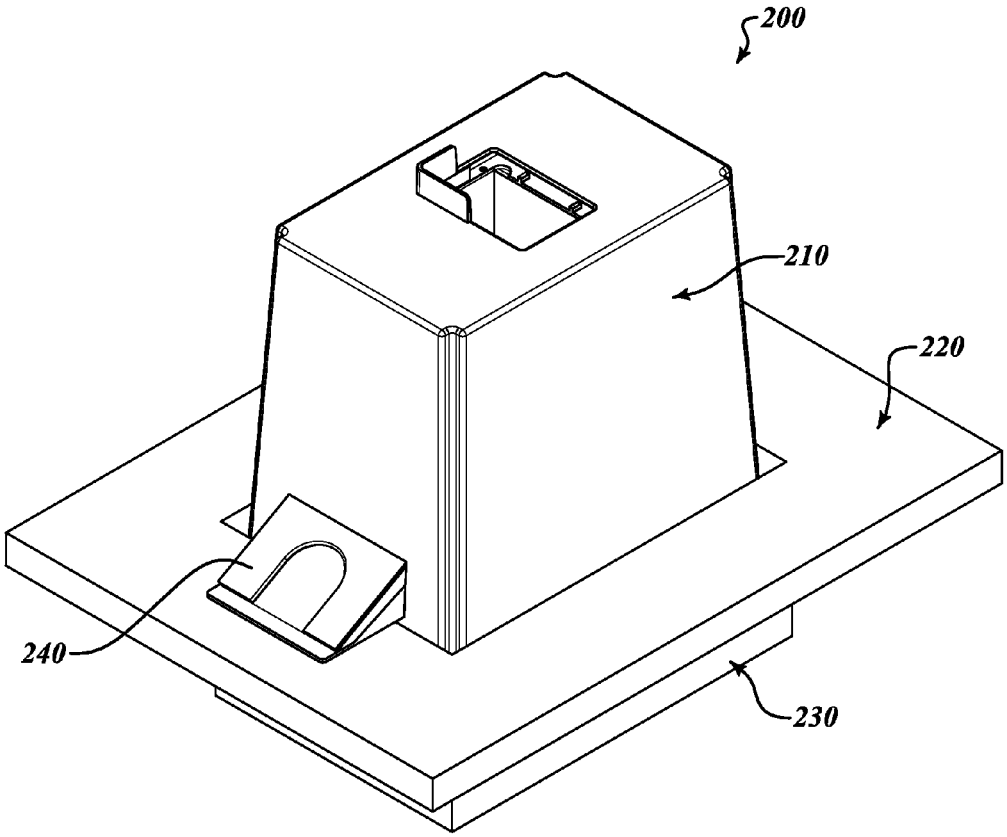
FIG. 24 is a perspective view of an alternative embodiment for a mechanical shuffler usable in accordance with principles of the present invention.

With reference now to FIGS. 24 through 27, an alternative embodiment for the invention is described. FIG. 24 shows a mechanical shuffler 200 usable in accordance with principles of the present invention where several decks can be loaded into the shuffler at one time. There are several casino games requiring up to 6 or sometimes 8 decks of cards in order to keep the pace of play fast and to avoid having to reshuffle and thereby delay play. These games include but are not necessarily limited to Blackjack, Casino War, Baccarat, and mini Bacarat. The shuffler 200 has a cover 210 that extends through a table 220. The shuffler 200, in order to accommodate several decks, up to and including as many as 8 decks and perhaps more, will have a significant portion of the apparatus located below the table 220. The cover 210 for shuffler 200 is of substantially the same design as the cover for other embodiments described herein The shuffler 200 operates on substantially the same mechanical principles as those described herein, namely, the vertical articulation of an unshuffled deck of cards relative to a slot that is disposed in a horizontal plane and sized to receive a single card that is delivered through the slot by a shim. Shuffler 200 differs from previous embodiments in that it may include a card delivery mechanism 240 that is similar to a traditional card delivery mechanism at the end of a traditional shoe of cards. Card delivery mechanism 240 permits the dealer to slide a single card at a time such as may be required for some casino game such as blackjack.

Figure 25:
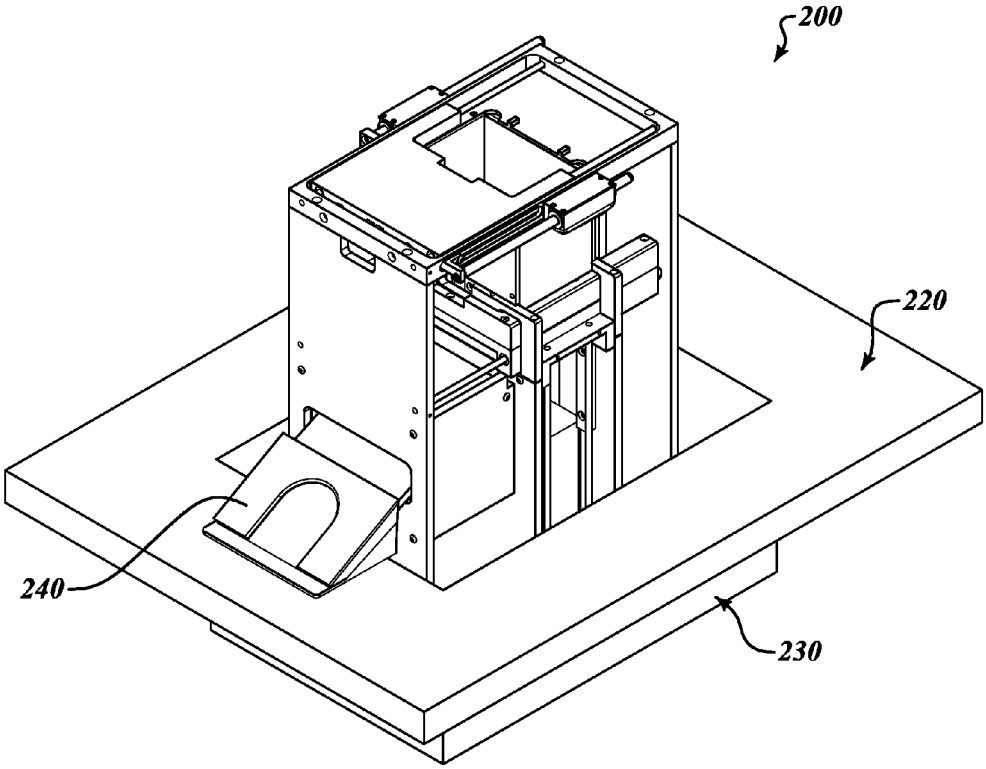
FIG. 25 is a perspective view of an alternative embodiment for a mechanical shuffler usable in accordance with principles of the present invention with the cover removed.
Figure 26:
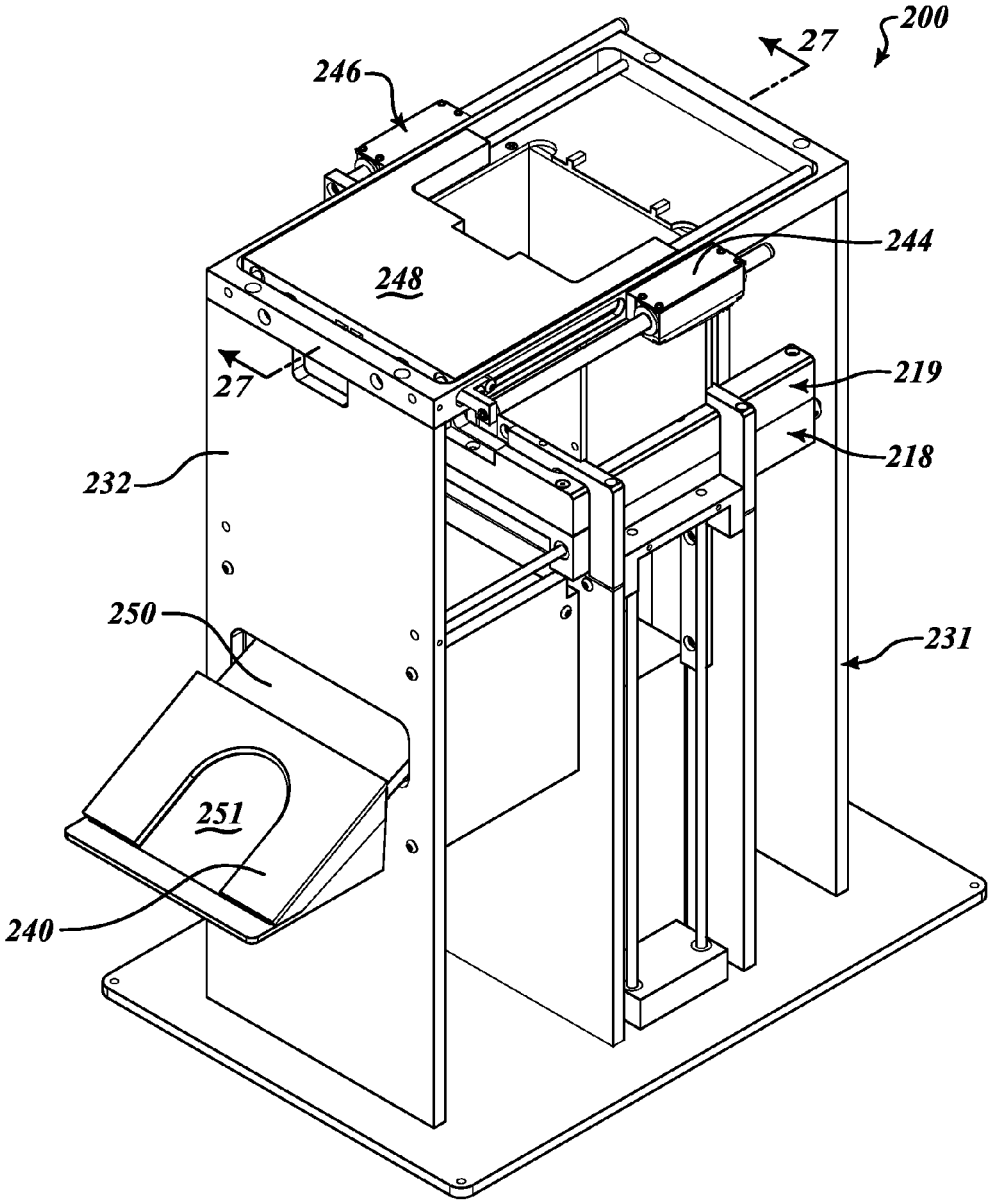
FIG. 26 is a perspective view of an alternative embodiment for a mechanical shuffler usable in accordance with principles of the present invention with the cover removed and the surrounding table removed to show mechanisms below the table.

The Shuffler 200 can be seen I FIGS. 25 and 26 without the cover, thereby exposing the inner mechanics of the shuffler. One of ordinary skill in the art will appreciate that the shuffler 200 operates on substantially the same mechanical principles of the invention that are described herein with respect to other embodiments, namely, the random, vertical articulation of a stack of unshuffled cards and delivery of a single card through a slot that is sized to receive a single card and deliver that card to an area where the dealer can provide randomized, shuffled cards to players of a casino game.

As seen in FIG. 26, the shuffler 200 includes a side wall 232, through which the card delivery mechanism 240 is disposed. Card delivery mechanism 240 includes a surface 251 upon which the car will slide as it is dealt by the dealer. Surface 251 can be a continuation of the same surface 250 where the shuffled card slides into the card delivery mechanism 240 once it passes through the slot. FIG. 26 also shows the inner workings of shuffler 200 to show that it operates on substantially the same mechanical principles of the invention that are described herein with respect to other embodiments, namely, the random, vertical articulation of a stack of unshuffled cards and delivery of a single card through a slot that is sized to receive a single card and deliver that card to an area where the dealer can provide randomized, shuffled cards to players of a casino game. The principal difference between shuffler 200 and the other embodiments disclosed herein is that it can hold more decks of cards.

Figure 27:
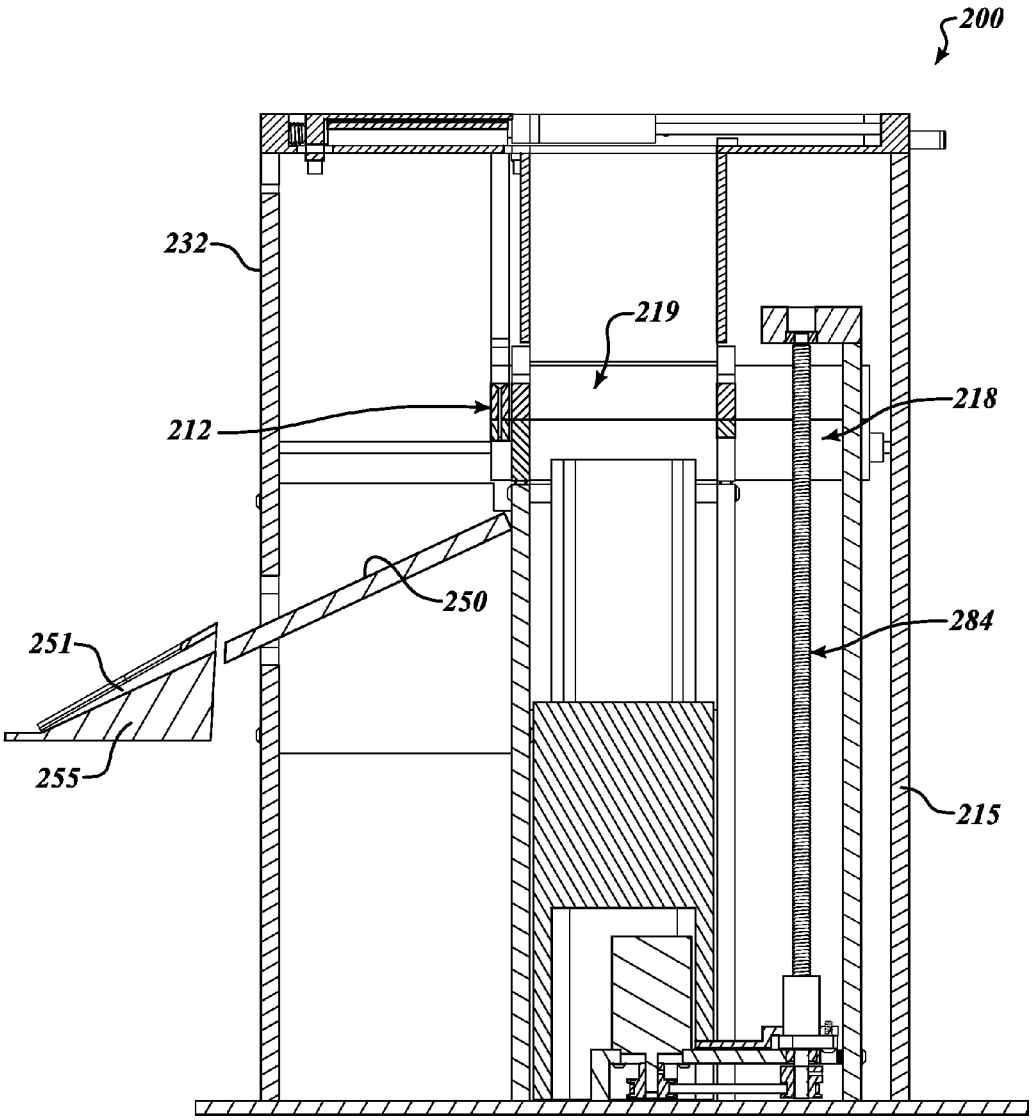
FIG. 27 is a cross-sectional side view of an alternative embodiment for a mechanical shuffler usable in accordance with principles of the present invention.

FIG. 27 shows a cross sectional view of shuffler 200, whereby the slot 212 can be seen. Further, surface 250 comprises the top surface of a slide member that delivers shuffled cards from the slot 212 to the card delivery mechanism. Space 251 has a decreasing, wedge-like shape such that shuffled cards will slide under the force of gravity into the card delivery mechanism, where the dealer can slide them out of the card delivery mechanism and deal them to players. The slope and shape of the block 255 is a non-limiting representation of an exemplary slope for card delivery mechanism.

As seen in FIG. 27, vertically articulating threaded rod 284 operates on substantially the same principles as described with respect to other embodiments. Likewise the shim assembly is comprised of at least two top and bottom members 219, and 218 respectively, to hold the shim so that the shim can be used to slide a single card from the stack of unshuffled cards through the slot 212.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A mechanical shuffler comprising:

a generally planar base, a platform sized to receive at least one deck of unshuffled cards, the platform movable in a direction of travel normal to the generally planar base, a first electrically powered motor mechanically coupled to the platform and configured to raise or lower the platform in response to a first signal, a slot positioned adjacent to the platform and sized to receive a single card from a deck of unshuffled cards wherein the deck of unshuffled cards rests atop the platform and wherein the slot is in communication with an area for the delivery of shuffled cards, a shim having a thickness less than the thickness of a single playing card and having a generally rectangular void, wherein the generally rectangular void is sized to allow the deck of unshuffled cards to pass through it and where the void has at least one side that is configured to contact at least one edge of the playing card in order to push the playing card through the slot and into the area for the delivery of shuffled cards, and wherein the shim is horizontally movable in a direction normal to the direction of travel of the platform such that the shim is able to pass through the deck of unshuffled cards and move a single card through the slot, and a second electrically powered motor mechanically coupled to the shim wherein said second electrically powered motor is configured to move the shim in response to a second signal.

2. The mechanical shuffler of claim 1 further comprising a computer wherein the computer includes a processor, a display, and a user interface.

3. The mechanical shuffler of claim 2 wherein the computer is configured to send said first signal to raise or lower said platform in accordance with instructions to randomly position the platform.

4. The mechanical shuffler of claim 3 wherein the computer is configured to send said second signal to move the shim after the platform is randomly positioned.

5. The mechanical shuffler of claim 4 wherein the computer is configured to move the shim to a location that delivers a single card through the slot to said area for the delivery of shuffled cards.

6. The mechanical shuffler of claim 1 wherein the size of the slot is adjustable.

7. The mechanical shuffler of claim 1 wherein the size of the slot is approximately 0.018 inches.

8. The mechanical shuffler of claim 1 wherein the shim is approximately 0.010 inches thick.

9. The mechanical shuffler of claim 1 including a free weight positioned atop the deck of unshuffled cards.

10. A mechanical shuffler comprising:

an elevator for vertically moving a stack of unshuffled cards, a slot positioned adjacent to the elevator and sized to receive a single card from a deck of unshuffled cards, and a shim having a generally rectangular void, where the void has at least one side that is configured to contact at least one edge of the playing card in order to push the playing card through the slot and into an area for the delivery of shuffled cards and wherein the generally rectangular void is sized to allow the deck of unshuffled cards to pass through it, and wherein the shim is horizontally movable in a direction normal to the direction of travel of the elevator and the unshuffled deck of cards such that the shim is able to pass through the deck of unshuffled cards and move a single card through the slot.

11. The mechanical shuffler of claim 10 wherein the size of the slot is adjustable.

12. The mechanical shuffler of claim 10 wherein the size of the slot is approximately 0.018 inches.

13. The mechanical shuffler of claim 10 wherein the shim has a thickness of less than the average thickness of a playing card.

14. The mechanical shuffler of claim 13 wherein the shim is approximately 0.010 inches thick.

15. The mechanical shuffler of claim 10 wherein the shim is configured to completely deliver a card from the unshuffled deck of cards, through the slot, and into an area for the delivery of shuffled cards.

16. A method for mechanically shuffling cards, the method comprising the steps of:

vertically moving a stack of unshuffled cards to a random position relative to a slot positioned adjacent to the stack of unshuffled cards, providing a shim having a generally rectangular void, wherein the generally rectangular void is sized to allow the deck of unshuffled cards to pass through it and where the void has at least one side that is configured to contact at least one edge of the playing card in order to push the playing card through the slot and into an area for the delivery of shuffled cards, providing a random-number generator, where the random-number generator is in communication with a vertically articulating motor that is mechanically coupled to a platform, that platform being configured to move the stack of unshuffled cards to a random position relative to the slot, and further configured to move the shim horizontally in a direction normal to the direction of travel of the unshuffled deck of cards such that the shim is able to pass through the deck of unshuffled cards and move a single card through the slot and such that a single card is selected at random from the stack of unshuffled cards and moved through the slot and into an area for the delivery of shuffled cards.

17. The method of claim 16, wherein a preselected number of cards are moved from the unshuffled stack of cards to the area for the delivery of shuffled cards.

18. The method of claim 17, wherein the preselected number of cards comprise a hand for a casino game.

19. The method of claim 18 wherein the casino game comprises Pai Gow, Caribbean Stud, 3-card poker, 4-card poker, Let it Ride, Ultimate Texas Holdem, Crazy 4, Hi Card Flush, or Mississippi Stud.

20. The method of claim 16 wherein the shim completely delivers a card from the stack of unshuffled cards to the area for the delivery of shuffled cards.

* * * * *